US008451183B2

(12) United States Patent
Penev et al.

(10) Patent No.: US 8,451,183 B2
(45) Date of Patent: May 28, 2013

(54) FREQUENCY-TUNABLE METAMATERIAL ANTENNA APPARATUS

(75) Inventors: Vladimir Penev, San Diego, CA (US); Vaneet Pathak, San Diego, CA (US)

(73) Assignee: Tyco Electronics Services GmbH (CH)

( * ) Notice: Subject to any disclaimer, the term of this patent is extended or adjusted under 35 U.S.C. 154(b) by 781 days.

(21) Appl. No.: 12/546,571

(22) Filed: Aug. 24, 2009

(65) Prior Publication Data

US 2010/0060544 A1 Mar. 11, 2010

Related U.S. Application Data

(60) Provisional application No. 61/094,839, filed on Sep. 5, 2008.

(51) Int. Cl.
*H01Q 9/00* (2006.01)

(52) U.S. Cl.
USPC ..... 343/745; 343/700 MS; 343/961

(58) Field of Classification Search
USPC ..... 343/745, 861, 700 MS
See application file for complete search history.

(56) References Cited

U.S. PATENT DOCUMENTS

| | | | | |
|---|---|---|---|---|
| 7,253,780 | B2 * | 8/2007 | Sievenpiper | 343/745 |
| 7,592,957 | B2 | 9/2009 | Achour et al. | |
| 7,911,386 | B1 * | 3/2011 | Itoh et al. | 343/700 MS |
| 8,063,839 | B2 * | 11/2011 | Ansari et al. | 343/745 |
| 2008/0048917 | A1 | 2/2008 | Achour et al. | |
| 2008/0258981 | A1 | 10/2008 | Achour et al. | |
| 2009/0128446 | A1 | 5/2009 | Gummalla et al. | |
| 2009/0135087 | A1 | 5/2009 | Gummalla et al. | |

FOREIGN PATENT DOCUMENTS

| | | |
|---|---|---|
| WO | 2007127955 | 11/2007 |
| WO | WO-2010027751 A1 | 3/2010 |

OTHER PUBLICATIONS

California Eastern Laboratories (CEL), Data Sheet—CMOS Integrated Circuit μPD5713TK, "Wide Band SPDT Switch", Doc. No. PU10627EJ01V0DS (1st edition), pp. 1-10, Sep. 2006.

Caloz and Itoh, *Electromagnetic Metamaterials: Transmission Line Theory and Microwave Applications*. John Wiley & Sons (2006).

Itoh, T., "Invited Paper: Prospects for Metamaterials," Electronics Letters, 40(16):972-973, Aug. 2004.

U.S. Appl. No. 61/056,790, filed May 28, 2008, entitled "Non-Planar Metamaterial Antenna Structures" by Xu et al.

Lai, A. et al., "Infinite Wavelength Resonant Antennas with Monopolar Radiation Pattern Based on Periodic Structures", IEEE Transactions on Antennas and Propagation, vol. 55(3). Mar. 2007. pp. 868-876.

Lim, S. et al., "Metamaterial-Based Electronically Controlled Transmission-Line Structure as a Novel Leaky-Wave Antenna With Tunable Radiation Angle and Beamwidth", IEEE Transactions on Microwave Theory and Techniques, vol. 52(12). Dec. 2004. pp. 2678-2690.

Wu, Chien-Hung et al., "A novel small planar antenna utilizing cascaded right/left-handed transmission lines", IEEE Antennas and Propagation Society INternational Symposium 2007, Jun. 9-15, 2007, Honolulu, HI USA. Jun. 2007. pp. 1889-1892.

International Search Report and Written Opinion dated Jan. 4, 2010 regarding International Application No. PCT/US2008/054811 filed Aug. 24, 2009. (12 pages).

* cited by examiner

*Primary Examiner* — Hoang V Nguyen
*Assistant Examiner* — Kyana R McCain

(57) ABSTRACT

Techniques and apparatus based on metamaterial structures to achieve tunable operations of an antenna at different antenna frequencies.

29 Claims, 25 Drawing Sheets

FREQUENCY-TUNABLE METAMATERIAL ANTENNA APPARATUS

PRIORITY CLAIM AND RELATED APPLICATION

This patent document claims the benefits of U.S. Provisional Patent Application Ser. No. 61/094,839 entitled "Frequency-Tunable Metamaterial Antenna Apparatus" and filed on Sep. 5, 2008. The disclosure of the above provisional application is incorporated by reference as part of the disclosure of this document.

BACKGROUND

This document relates to Composite Right-Left Handed (CRLH) Metamaterial (MTM) antenna apparatus.

The propagation of electromagnetic waves in most materials obeys the right-hand rule for the (E,H,β) vector fields, where E is the electrical field, H is the magnetic field, and β is the wave vector (or propagation constant). The phase velocity direction is the same as the direction of the signal energy propagation (group velocity) and the refractive index is a positive number. Such materials are "right handed (RH)" materials. Most natural materials are RH materials. Artificial materials can also be RH materials.

A metamaterial (MTM) has an artificial structure. When designed with a structural average unit cell size of ρ much smaller than the wavelength of the electromagnetic energy guided by the metamaterial, the metamaterial can behave like a homogeneous medium to the guided electromagnetic energy. Unlike RH materials, a metamaterial can exhibit a negative refractive index, and the phase velocity direction is opposite to the direction of the signal energy propagation where the relative directions of the (E,H,β) vector fields follow the left-hand rule. Metamaterials that support only a negative index of refraction with permittivity ∈ and permeability μ being simultaneously negative are pure "left handed (LH)" metamaterials.

Many metamaterials are mixtures of LH metamaterials and RH materials and thus are Composite Right and Left Handed (CRLH) metamaterials. A CRLH metamaterial can behave like a LH metamaterial at low frequencies and a RH material at high frequencies. Implementations and properties of various CRLH metamaterials are described in, for example, Caloz and Itoh, "Electromagnetic Metamaterials: Transmission Line Theory and Microwave Applications," John Wiley & Sons (2006). CRLH metamaterials and their applications in antennas are described by Tatsuo Itoh in "Invited paper: Prospects for Metamaterials," Electronics Letters, Vol. 40, No. 16 (August, 2004).

CRLH metamaterials can be structured and engineered to exhibit electromagnetic properties that are tailored for specific applications and can be used in applications where it may be difficult, impractical or infeasible to use other materials. In addition, CRLH metamaterials may be used to develop new applications and to construct new devices that may not be possible with RH materials.

SUMMARY

Techniques and apparatus based on metamaterial structures are provided to achieve tunable operations of an antenna at different antenna frequencies.

In one aspect, a method is provided for providing a multi-frequency operation from a single antenna. This method includes structuring a Composite Right-Left Handed (CRLH) Metamaterial (MTM) antenna to exhibit antenna resonances at two or more antenna frequencies; electrically coupling the CRLH MTM antenna to a ground electrode; and adjusting the electrical coupling between the CRLH MTM antenna and the ground electrode to change an electrical length of the electrical coupling to change an operating frequency of the CRLH MTM antenna. This change can be implemented by changing the electrical length for the path connecting the CRLH antenna to the ground electrode or the dimension of the CRLH MTM antenna to change the effective electrical length of the electrical coupling between the CRLH MTM antenna and the ground electrode.

In another aspect, a metamaterial (MTM) antenna device is provided and includes a ground electrode; an MTM cell comprising an electrode cell patch; a launch stub located close to and electromagnetically coupled to the MTM cell to direct an antenna signal to or from the MTM cell; a feed line for delivering power of the antenna signal to or from the launch stub; a via line electrically coupled to the MTM cell; a tuning circuit coupling the via line to the ground electrode; and a control circuit controlling the tuning circuit which changes an electrical length of the via line coupled to the ground electrode upon receiving a control signal from the control circuit to change an antenna frequency which varies with the length of the via line.

In another aspect, a metamaterial (MTM) antenna device is provided to include a ground electrode, MTM cell segments separated from and adjacent to one another to form an array with a first MTM cell segment on a first end of the array, a launch stub that is electrically conductive and located close to and electromagnetically coupled to the first cell segment to direct an antenna signal to or from the first MTM cell segment, a feed line that is electrically conductive and is coupled to the launch stub to deliver power to or from the launch stub, a via line that is electrically conductive and is coupled to the first MTM cell segment to the ground electrode, a tuning circuit coupling the plurality of MTM cell segments, and a control circuit controlling the tuning circuit to change a length of the array by generating a control signal to control connection between the first MTM cell segment and other MTM cell segments in changing an antenna frequency of the antenna signal based on the length of the array.

In another aspect, a metamaterial (MTM) antenna device is provided to include a dielectric substrate, a ground electrode formed on the substrate, a MTM cell formed on the substrate and comprising a conductive cell patch, and a conductive via line formed on the substrate at a location adjacent to and separated from the conductive cell patch. The via line includes a portion that is electromagnetically coupled to at least a portion of the conductive cell patch and a second portion that is electrically connected to the ground electrode. This device also includes a tunable circuit element coupled to the via line and operable to adjust an effective electrical length of the via line to tune a frequency of the MTM cell.

In yet another aspect, a metamaterial (MTM) antenna device is provided to include a multilayer MTM antenna that includes antenna components formed in multiple metallization layers, and a tuning circuit comprising two or more conductive paths positioned relative to the multilayer MTM antenna. The two or more conductive paths have different electrical lengths. This device includes a control circuit that is coupled to the tuning circuit and controls the tuning circuit by selecting one of the two or more conductive paths to connect to the multilayer MTM antenna to operate the multilayer antenna at an antenna frequency defined by the selected electrical length of the selected one conductive path while leaving one or more other conductive paths unconnected to the multilayer MTM antenna.

These and other aspects are described in greater detail in the drawings, the description and the claims.

DETAILED DESCRIPTION

Metamaterial (MTM) structures can be used to construct antennas, transmission lines and other RF components and devices, allowing for a wide range of technology advancements such as functionality enhancements, size reduction and performance improvements. These MTM-based components and devices can be designed by using CRLH unit cells. As illustrated below, a Composite Right-Left Handed (CRLH) Metamaterial (MTM) antenna can be structured to exhibit antenna resonances at two or more antenna frequencies by electrically coupling the CRLH MTM antenna to a ground electrode. The electrical coupling between the CRLH MTM antenna and the ground electrode can be adjusted by, e.g., changing a connection between the electrode and the CRLH MTM antenna or a dimension of the CRLH MTM antenna, to change an electrical length of the electrical coupling to change the operating frequency of the CRLH MTM antenna to one the two or more antenna frequencies.

Figure 1A:
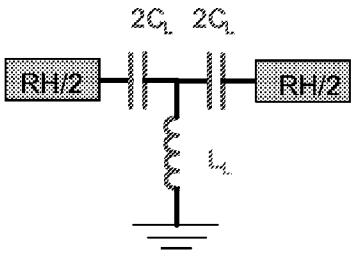
FIGS. 1A through 1F illustrate various circuit elements representing equivalent circuit parameters for a CRLH unit cell.
Figure 1B:
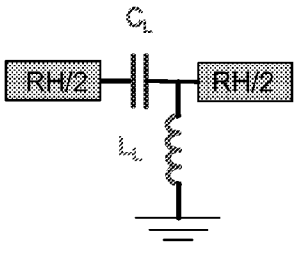
Figure 1C:
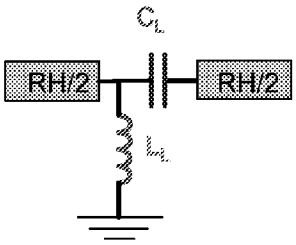
Figure 1D:
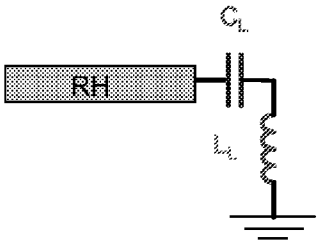
Figure 1E:
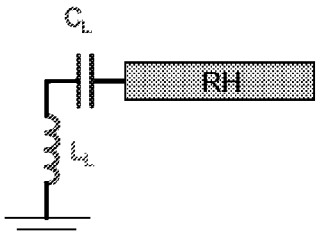
Figure 1F:
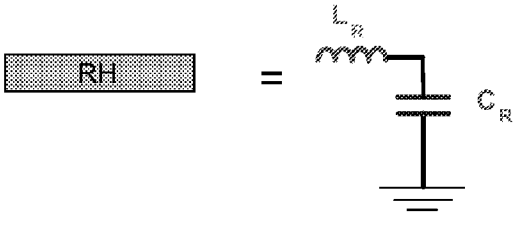

FIGS. 1A-1E show examples of the CRLH unit cells, where $L_R$ is a RH series inductance, $C_L$ is a LH series capacitance, $L_L$ is a LH shunt inductance, and $C_R$ is a RH shunt capacitance. These elements represent equivalent circuit parameters for a CRLH unit cell. The block indicated with "RH" in these figures represents an RH transmission line, which can be equivalently expressed with the RH shunt capacitance $C_R$ and the RH series inductance $L_R$, as shown in FIG. 1F. Variations of the CRLH unit cell include a configuration as shown in FIG. 1A but with RH/2 and CL interchanged; and configurations as shown in FIGS. 1A-1C but with RH/4 on one side and 3RH/4 on the other side instead of RH/2 on both sides. The MTM structures can be implemented based on these CRLH unit cells by using distributed circuit elements, lumped circuit elements or a combination of both, and can be fabricated on various circuit platforms, including circuit boards such as an FR-4 Printed Circuit Board (PCB) or a Flexible Printed Circuit (FPC) board. Examples of other fabrication techniques include thin film fabrication techniques, system on chip (SOC) techniques, low temperature co-fired ceramic (LTCC) techniques, and monolithic microwave integrated circuit (MMIC) techniques.

A pure LH metamaterial follows the left-hand rule for the vector trio (E,H,β), and the phase velocity direction is opposite to the signal energy propagation direction. Both the permittivity $\in$ and permeability $\mu$ of the LH material are simultaneously negative. A CRLH metamaterial can exhibit both left-handed and right-handed electromagnetic properties depending on the regime or frequency of operation. The CRLH metamaterial can exhibit a non-zero group velocity when the wavevector (or propagation constant) of a signal is zero. In an unbalanced case, there is a bandgap in which electromagnetic wave propagation is forbidden. In a balanced case, the dispersion curve does not show any discontinuity at the transition point of the propagation constant $\beta(\omega_o)=0$ between the left- and right-handed regions, where the guided wavelength is infinite, i.e., $\lambda_g=2\pi/|\beta|\rightarrow\infty$, while the group velocity is positive:

$$v_g = \frac{d\omega}{d\beta}\bigg|_{\beta=0} > 0. \qquad \text{Eq. (1)}$$

This state corresponds to the zeroth order mode m=0 in a transmission line (TL) implementation. The CRLH structure supports a fine spectrum of resonant frequencies with the dispersion relation that extends to the negative β region.

Figure 2:
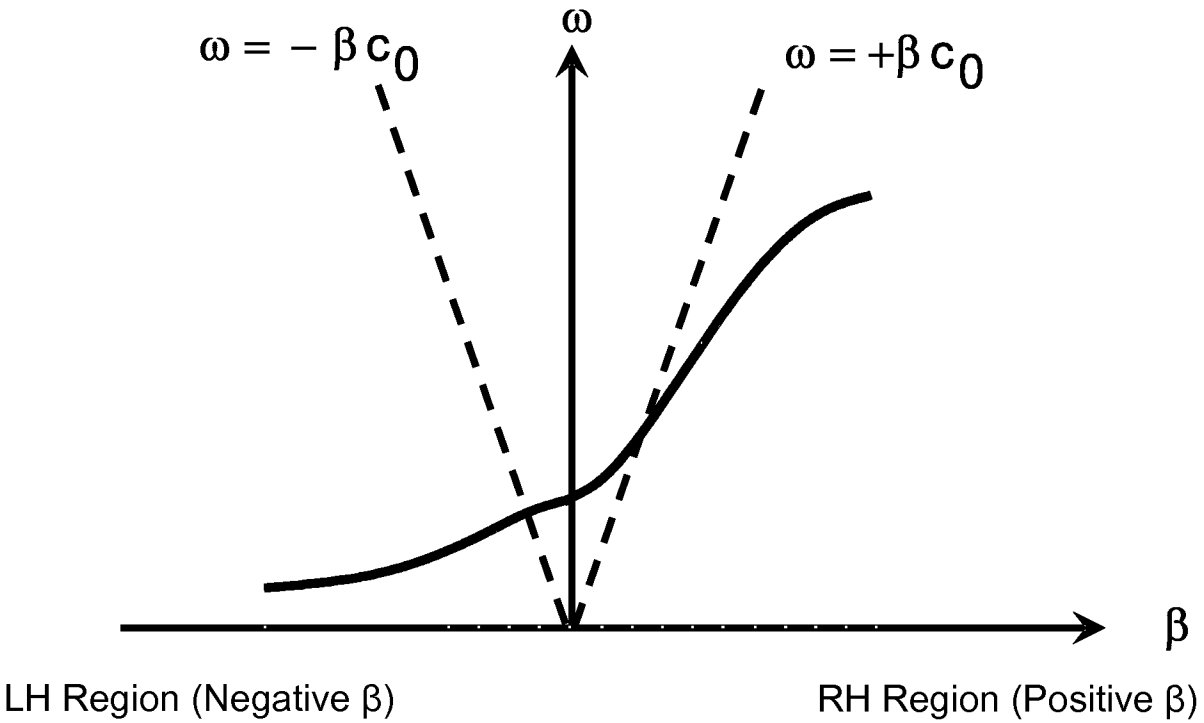
FIG. 2 illustrates a dispersion curve using a balanced CRLH unit cell.

FIG. 2 shows the dispersion curve using a balanced CRLH unit cell. In the unbalanced case, there are two possible zeroth order resonances, $\omega_{se}$ and $\omega_{sh}$, which can support an infinite wavelength ($\beta=0$, fundamental mode) and are expressed as:

$$\omega_{sh} = \frac{1}{\sqrt{C_R L_L}} \text{ and } \omega_{se} = \frac{1}{\sqrt{C_L L_R}}, \quad \text{Eq. (2)}$$

where $C_R L_L \neq C_L L_R$. At $\omega_{se}$ and $\omega_{sh}$, both group velocity ($v_g=d\omega/d\beta$) and the phase velocity ($v_p=\omega/\beta$) are zero. When the CRLH unit cell is balanced, these resonant frequencies coincide as shown in FIG. 2 and are expressed as:

$$\omega_{se}=\omega_{sh}=\omega_0, \quad \text{Eq. (3)}$$

where $C_R L_L = C_L L_R$. At $\omega_{se}$ and $\omega_{sh}$, the positive group velocity ($v_g=d\omega/d\beta$) and the zero phase velocity ($v_p=\omega/\beta$) can be obtained. For the balanced case, the general dispersion curve can be expressed as:

$$\beta = \omega\sqrt{L_R C_R} - \frac{1}{\omega\sqrt{L_L C_L}}. \quad \text{Eq. (4)}$$

The propagation constant $\beta$ is positive in the RH region, and that in the LH region is negative. Therefore, the LH properties are dominant in the low frequency region, and the RH properties are dominant in the high frequency region.

Various elements of a Composite Right and Left Handed (CRLH) Metamaterial (MTM) antenna device can be constructed by using a single or multilayer substrate as described in U.S. patent application Ser. No. 12/250,477 filed on Oct. 13, 2008 entitled "Single-Layer Metallization and Via-Less Metamaterial Structures" and U.S. patent application Ser. No. 12/270,410 filed on Nov. 13, 2008 entitled "Metamaterial Structures with Multilayer Metallization and Via" which are incorporated by reference as part of the disclosure of this document. For example, an CRLH MTM antenna device can be designed to include an MTM cell and a grounded CPW (coplanar waveguide) which feeds power into an antenna element through a feed line. The feed line can serve as an impedance matching device, delivering power from the CPW line to the distal end of the feed line (launch stub). A narrow gap is provided between the distal end of the feed line (launch stub) and the MTM cell to electromagnetically couple these elements. The width of the gap can range between 4-8 mils, for example. The MTM cell is coupled to the ground (GND) through a via line. The resonant frequencies, matching of multiple modes, and associated efficiencies can be controlled by changing the size of the MTM cell, length of the via line, length of the feed line, distance between the antenna element and the ground, and various other dimensions and layouts. Unlike conventional antennas, the MTM antenna resonances are affected by the presence of the left handed (LH) mode. The LH mode can be used to facilitate and excite low resonances and provide impedance matching for the low resonances. In addition, the LH mode can be used to improve the impedance matching of high resonances.

A number of design parameters and features of a CRLH MTM antenna can be used in designing the antenna for achieving certain antenna properties for specific applications. Some examples are provided below.

For example, the launch stub can have various geometrical shapes, such as but not limited to, rectangular, irregular, spiral, meander or a combination of different shapes. The MTM cell can have various geometrical shapes, such as but not limited to, rectangular, spiral, circular, oval, meander, polygonal, irregular or a combination of different shapes. The gap between the launch stub and the MTM cell can take various forms, such as but not limited to, straight line, curved, L-shape, meander, zigzag, discontinuous line, or enclosing line. The via line and/or feed line can be located on the top or bottom layer of the substrate. The via line and/or feed line can have various geometrical shapes and lengths, such as but not limited to, rectangular, irregular, spiral, meander or a combination of different shapes. A multilayer substrate can be used to accommodate various parts in different layers for achieving a 3-dimensional antenna structure. A non-planar substrate can be used to accommodate various parts in different planes for foot-print reduction. Multiple MTM cells may be cascaded in series creating a multi-cell 1D structure. Multiple MTM cells may be cascaded in orthogonal directions generating a 2D structure. A single feed line may be configured to feed multiple MTM cells. A meandered stub may be added and extended from the feed line to introduce an extra resonance, including one or more resonances below 1 GHz. The meandered stub can have various geometrical shapes, such as but not limited to, rectangular, spiral, circular, oval, and other shapes). In addition, the meandered stub can be placed on the top, middle or bottom layer, or a few millimeters above the substrate.

One or more of these and other features can be implemented in a particular antenna device such as a frequency-tunable CRLH Metamaterial (MTM) antenna, for example.

For MTM antenna devices, frequency tuning can be a desirable feature in various antenna applications. For example, as wireless technology advances, the number of global wireless standards also increases. Thus, wireless transmissions today generally require multiple antennas operating in various frequency bands. To reduce the overall size and the unwanted interferences arising from electromagnetic interactions among the antennas, a single tunable antenna may be used in place of such multiple antennas that are not tunable in frequency and are designed to operate at certain frequency bands. Hence, frequency tunable antennas can be especially useful in a situation where the wireless standards are in close proximity to one another. A tunable circuit element can be employed in an frequency-tunable antenna device to tune the antenna by adjusting its electrical length to vary the frequency.

Under certain configurations, frequency-tunable CRLH MTM antenna structures described herein can be used to generate multiple radiating resonances with high efficiency. In the ensuing examples, the electrical lengths respectively associated with the via line length, the position of the via line, and the MTM cell length can be varied for tuning the operating frequency of the antenna.

Tuning a CRLH MTM antenna device can be accomplished by using one or more adjustable or tunable circuit elements. Examples of such circuit elements can be implemented to include active components such as PIN diodes and switches, e.g., single pole double throw (SPDT) switches and switches with a single pole and three or more throws. Other electrical lengths can be varied by using different types of tuning components.

The antenna designs described in herein are suitable for various applications, including but not limited to, an antenna system with a port that covers multiple disconnected bands, an antenna system with a port to cover multiple connected bands, an antenna system with a port to improve the efficiency of one band based on existing modes in the same band, and an antenna system with a port to improve the efficiency of one band based on the environment of the wireless device.

These antenna structures can be fabricated by using a single, double, or multi-layer PCB or Flexible Printed Circuit (FPC) board. Examples of other fabrication techniques include a thin film fabrication technique, a system on chip (SOC) technique, a low temperature co-fired ceramic (LTCC) technique, and a monolithic microwave integrated circuit (MMIC) technique.

Table 1.0 presents examples of some basic components and features associated with a frequency-tunable MTM antenna. In implementing a frequency-tunable MTM antenna based on the designs in this document, various components may be used, including components used in other MTM and non-MTM antennas. Examples of such components include a grounded CPW (coplanar waveguide) line for feeding power into an antenna element through a feed line and a launch stub; a narrow gap to electromagnetically couple an MTM cell and the launch stub, which is connected to a ground (GND) through a via line; and a tuning component, either a PIN diode or an SPDT, and associated passive components which are included at certain locations for changing the associated electrical length.

TABLE 1.0

Components of a basic frequency-tunable MTM antenna design

| Parameter | Description |
|---|---|
| 50 Ω CPW line | Connects an antenna feed point to the feed line. |
| Feed Line | Connects the launch stub with the 50 Ω CPW line. |
| Launch Stub | Substantially rectangular shaped stub that delivers electromagnetic energy to an MTM cell by E&M coupling over a slim gap. |
| MTM Cell | Substantially rectangular shaped. |
| Via Line | Connects the MTM cell to GND. |
| Tuning Component | Either PIN diode or SPDT (Single Pole Double Through) switch that switches in and out certain parts of the structure. |

Figure 3A:
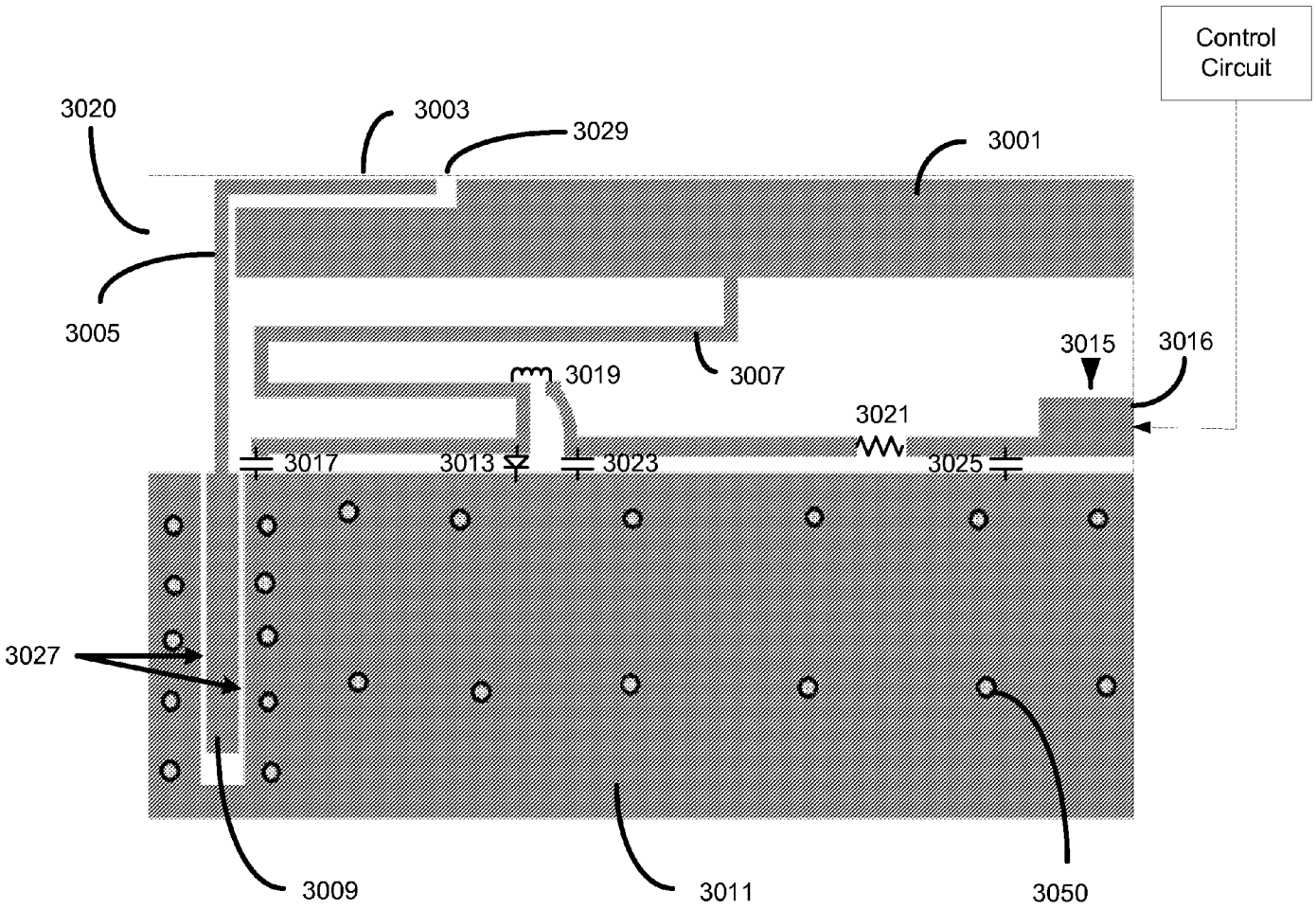
FIGS. 3A through 3C illustrate structures of the top and bottom metallization layers, respectively, of an exemplary frequency-tunable metamaterial antenna apparatus having a tunable circuit structure.
Figure 3B:
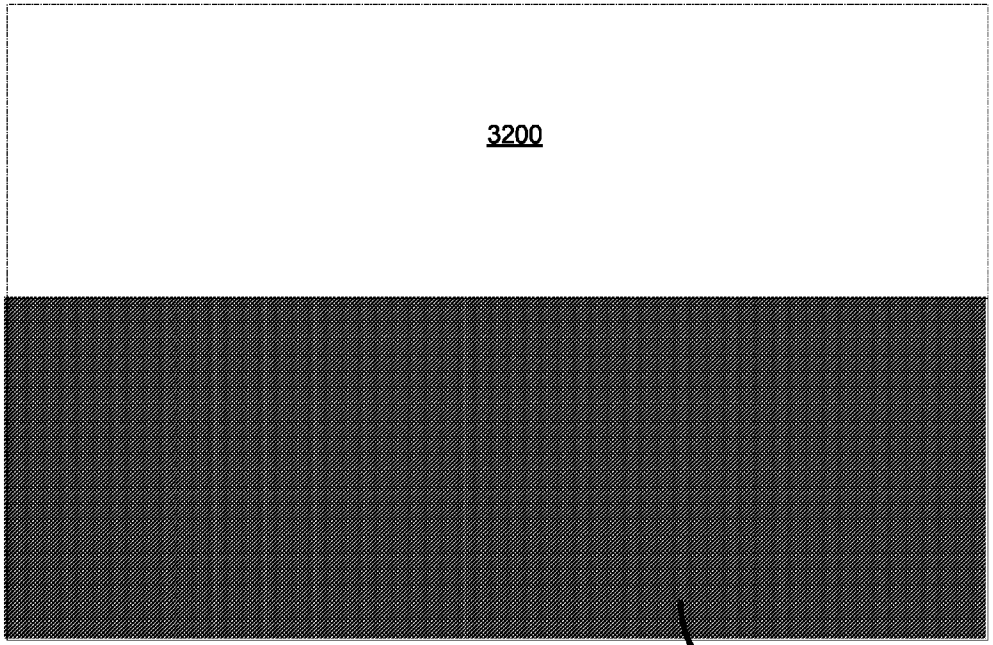
Figure 3C:
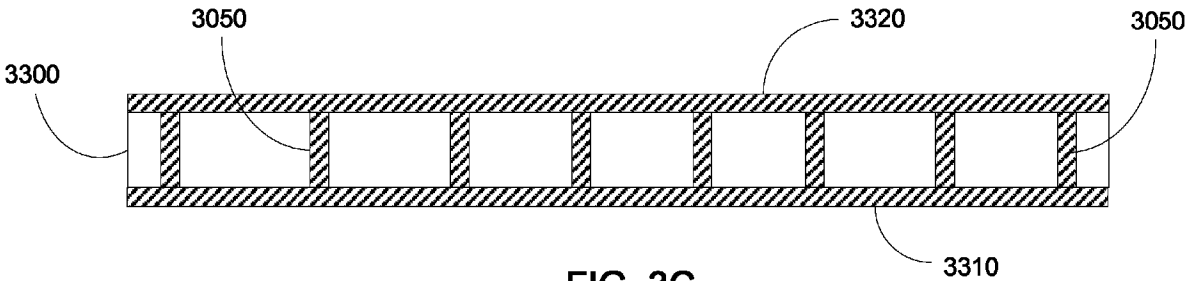

FIGS. 3A, 3B and 3C illustrate an example of a frequency-tunable MTM antenna. This antenna is formed on a substrate 3300 with two metallization layers 3310 and 3320 formed on two opposing surfaces of the substrate 3300. In the top metallization layer 3320, the antenna includes an MTM cell 3001 formed of a conductive material, a launch stub 3003 formed of a conductive material, a feed line 3005 formed of a conductive material, a via line 3007 formed of a conductive material, a CPW line 3009 (e.g., with an impedance of 50Ω), and a top ground electrode GND 3011. These components can be formed by patterning the top metallization layer 3320. The bottom metallization layer 3310 includes a bottom ground electrode GND 3100 that is connected to the top ground electrode GND 3011 by an array of vias 3050 formed in the substrate 3300. As illustrated in FIGS. 3A and 3B, the MTM cell 3001, the launch stub 3003, the feed line 3005 and the via line 3007 are formed in the region 3020 outside the region occupied by the ground electrode 3011. The bottom ground 3100 is formed beneath the top ground electrode 3011 and is outside the region 3200 which is underneath the region 3020. Certain information of these components are described hereinabove and in Table 1.0.

In addition to these components, the antenna in FIGS. 3A-3B also includes a PIN diode D1 3013, which is placed between the via line 3007 and top ground GND 3011. The control signal for the PIN diode D1 3013 is provided by a control voltage Vcontrol 3015, which is controlled by a control circuit such as a processor. In response to a command sent from the processor, Vcontrol 3015 can assume two states that correspond to a logic low state and a logic high state, respectively. When the state of Vcontrol 3015 is at the logic low state, the PIN diode 3013 is turned off and the via line 3007 is coupled to the top ground GND 3011 through a capacitor C1 3017 to effectuate a long electrical path for connecting the cell 3001 to the top ground GND 3011. As a result, the antenna is tuned to the lower frequency. When the state of Vcontrol 3015 is set the logic high state, the PIN diode 3013 is turned on and the via line 3007 is coupled to the ground GND 3011 through the forward-biased diode D1 3013, resulting in a short electrical line for connecting the cell 3001 to the ground GND 3011. This operation makes the antenna to be tuned to a higher resonance frequency.

In an alternative configuration, it is possible to reverse the logic states as used above so as to turn ON the PIN diode 3013 at the logic low state, and turn OFF the PIN diode 3013 at the logic high state. Thus, when the PIN diode 3013 is set to the logic low state, the antenna is tuned to a higher frequency. When the PIN diode 3013 is at the logic high state, the antenna is tuned to a lower frequency.

In FIGS. 3A-3B, the via line 3007 is coupled to top ground GND 3011 through a capacitor C1 3017. For signals at RF frequencies, the capacitor C1 3017 exhibits a low impedance and thus provides a connection between the via line 3007 and ground GND 3011. For a direct current (DC) signal, the capacitor C1 3017 acts as an open circuit that does not interfere with the PIN Diode D1 3013 bias. An RF choke (RFC) 3019 is provided and is an inductor with a high impedance at RF frequencies, which typically measures several hundred ohms. A control signal electrode 3016 is provided to receive the control signal Vcontrol 3015 from the control circuit of the antenna and the RFC 3019 is coupled between the control signal electrode and the via line 3007 to supply the control signal Vcontrol 3015 to the PIN diode 3013. The RFC 3019 can isolate the control signal Vcontrol 3015 from the via line 3007. A resistor R1 3021 can be used to control the amount of the current through the PIN diode 3013. A typical value for R1 3021 measures about 430Ω, which sets the current through the PIN diode 3013 to 5 mA when a control voltage of 2.8V is applied. Capacitors C2 3023 and C3 3025 can be used to reduce the noise on the control line that may come from the processor.

As a specific example, listed below are exemplary values of design parameters used for implementing the frequency-tunable MTM antenna with the PIN diode 3013 shown in FIGS. 3A-3B. The size of the PCB is about 52 mm wide and 105 mm long, with a 1 mm thickness. The material is FR4 with a permittivity of 4.4. The antenna device has a total height which is about 10 mm above ground GND 1011 and has a total length which is about 36 mm. The grounded CPW line 3009 is about 1.01 mm wide with a 0.2 mm air-gap 1027 on both sides and functions as a 50Ω transmission line for the FR4 substrate. The feed line 3005 measures about 8 mm in length and 0.8 mm in width. The launch stub 3003 measures about 8 mm in length and 0.4 mm in width. The MTM cell 3001 has a length of about 34 mm and a width of about 4 mm. A 0.2 mm gap 1029 lies between the MTM cell 3001 and the launch stub 3003. The total length of the via line 3007 grounding the MTM cell 3001 measures about 45 mm. The via line 3007 can be bent into a certain shape to achieve a desired length to fit into a limited space as shown in FIG. 3A. The PIN diode 3013 is positioned at 10 mm from the grounding point of the via line. A commercially available PIN diode, such as NXP Semiconductor BAP63-3, for example, can be used as the PIN diode 3013. When the PIN diode 3013 is ON, it has a low resistance which measures approximately 2Ω. When the PIN diode 3013 is OFF, it acts as a small capacitor having a capacitance measuring approximately 0.4 pF.

The MTM antenna 3001 in FIGS. 3A-3B can be configured to tune to the GSM850 band (824-894 MHz) and GSM900 band (880-960 MHz). Commands associated with identification of these bands can be sent from a control circuit (e.g., a processor) to control Vcontrol 3015. For example, the MTM antenna 3001 can be configured so that Vcontrol of 0 volts selects GSM850 and Vcontrol of 2.8V selects GSM900, or vice versa. Note that the MTM antenna in the present embodiment is designed to cover the DCS-1800 (1710-1880 MHz) and PCS-1900 (1850-1990 MHz) bands as well.

Figure 4:
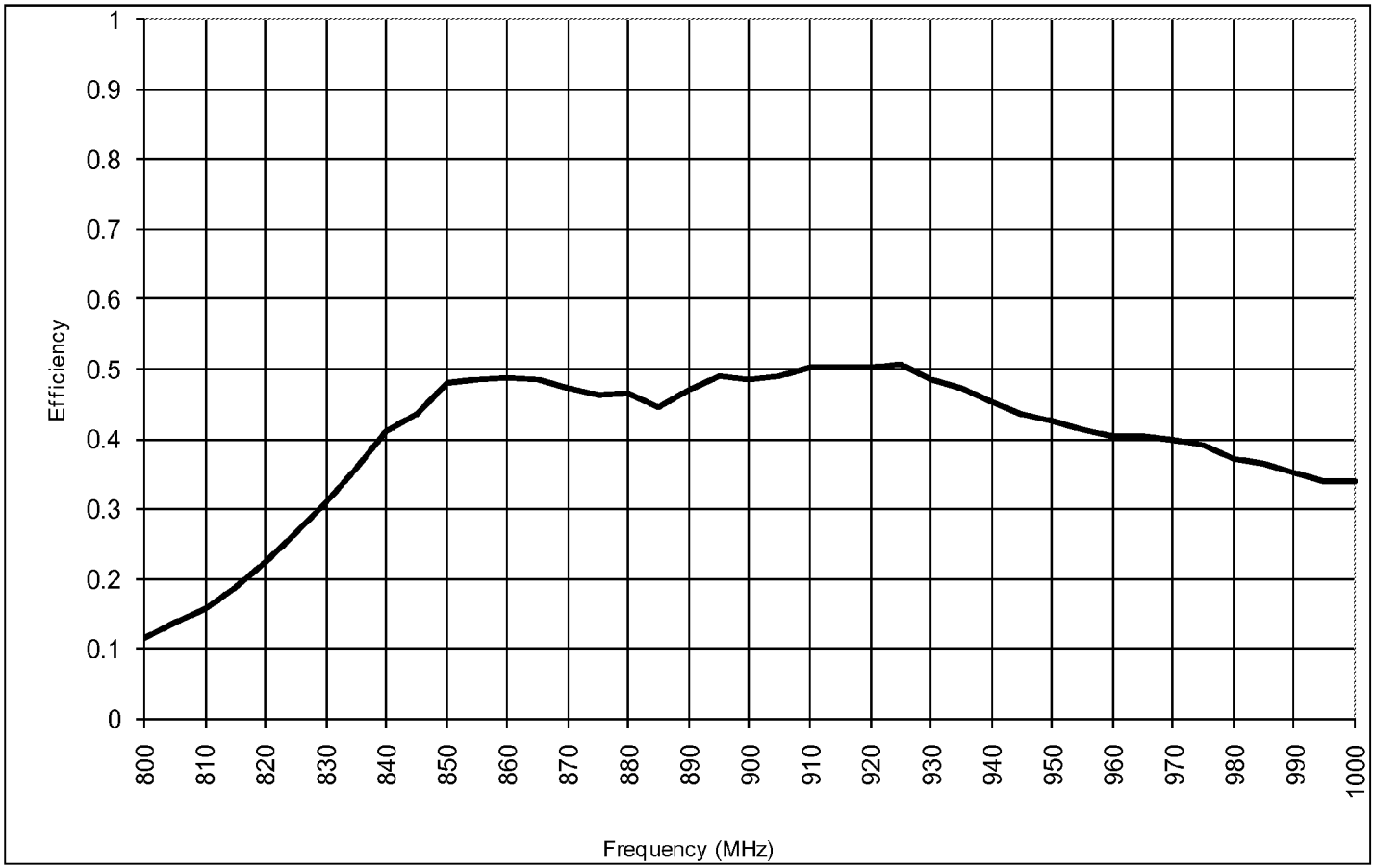
FIG. 4 illustrates a measured efficiency plot in GSM850 and GSM900 for the antenna apparatus of FIG. 3.
Figure 5:
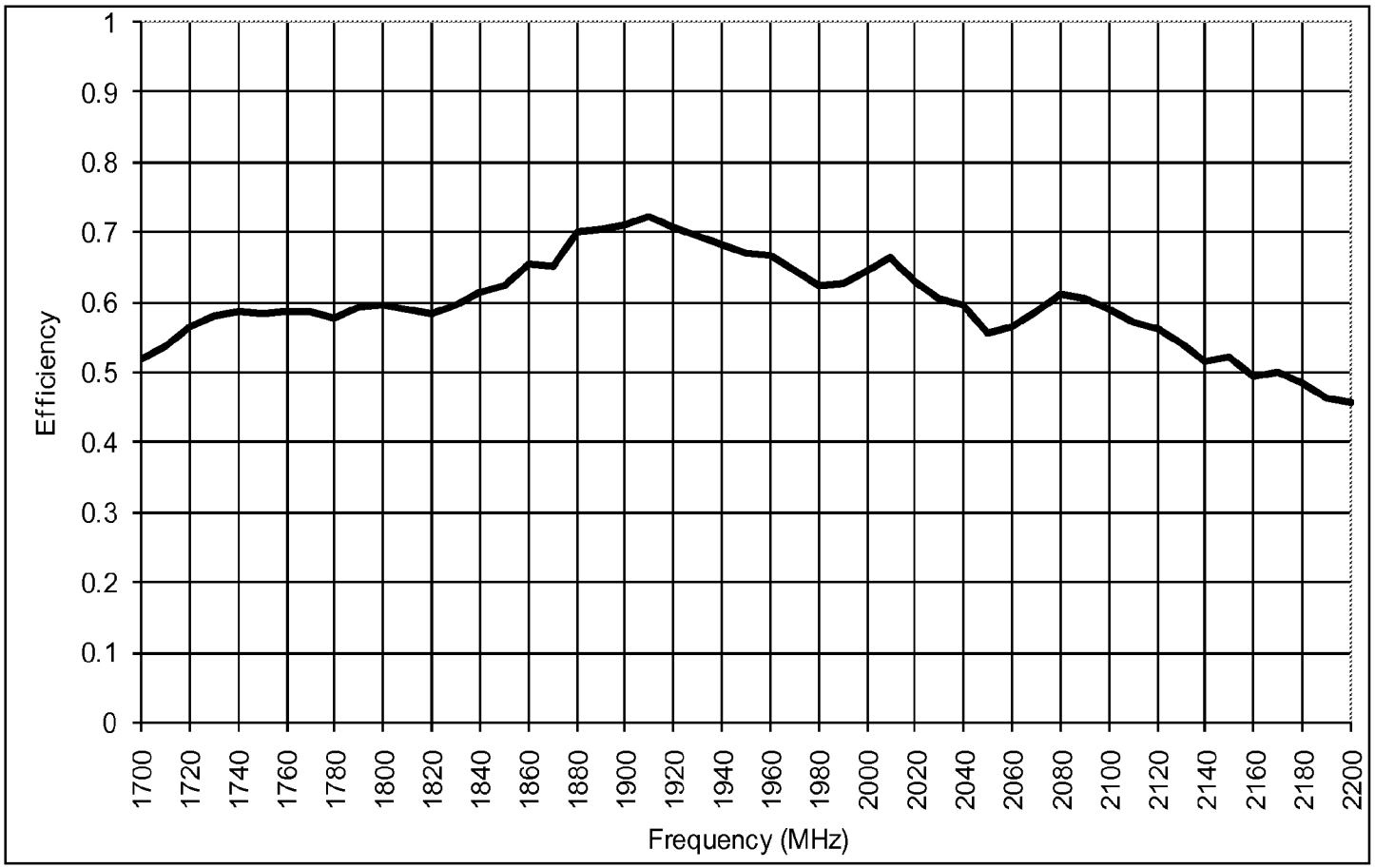
FIG. 5 illustrates a measured efficiency plot in DCS1800 and PCS1900 for the antenna apparatus of FIG. 3.

FIGS. 4 and 5 show measured efficiency results for the low band (GSM850 and GSM900) and the high band (DCS1800 and PCS1900), respectively.

In FIG. 4, at a frequency above 885 MHz, the PIN diode D1 3013 is forward biased, thereby providing a short via line; and at a frequency below 885 MHz, the PIN diode D1 3013 is reverse biased and the capacitor C1 3017 provides a connection between the via line 3007 and the top ground GND 3011, thereby providing a long via line.

In FIG. 5, at a frequency above 1850 MHz, the PIN diode D1 3013 is forward biased, thereby providing a short via line; and at a frequency below 1850 MHz, the PIN diode D1 3013 is reverse biased and the capacitor C13017 provides a connection between the via line 3007 and the top ground GND 3011, thereby providing a long via line.

Figure 6:
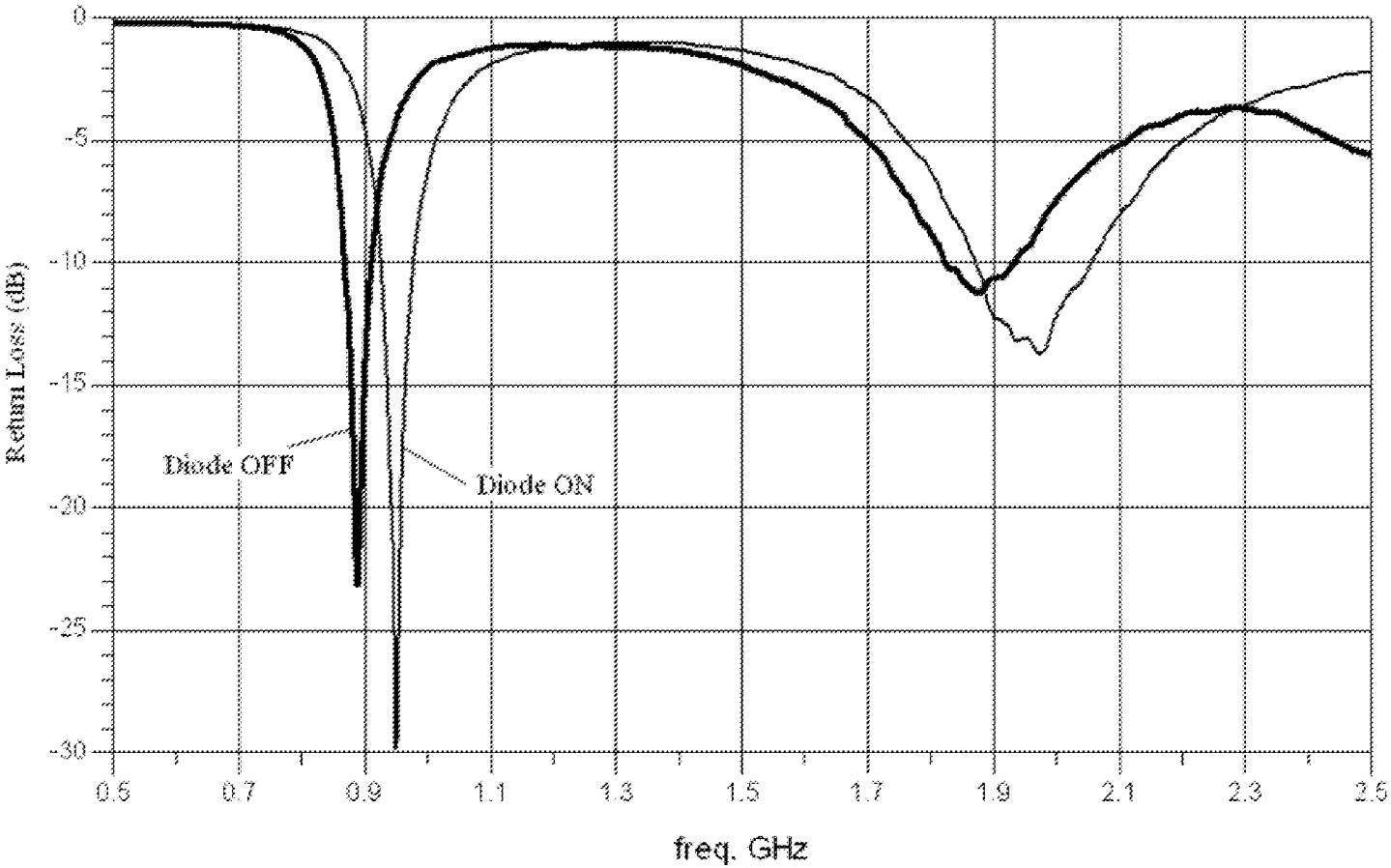
FIG. 6 illustrates a measured return loss plot for the antenna apparatus of FIGS. 3A and 3B.

FIG. 6 shows the measured return loss for the cases of the PIN diode D1 3013 being ON and OFF. The measurements show that the return loss is better than −6 dB in GSM850, GSM900, DCS1800 and PCS 1900 bands. When the PIN diode D1 3013 is OFF (reverse biased), the capacitor C1 3017 provides a connection between the via line 3007 and the top ground GND 3011, and both the low and high frequency resonances shift towards the lower frequency due to the resultant long electrical length. When the PIN diode D1 3013 is ON (forward biased), the PIN diode D1 3013 provides a connection between the via line and the ground, and both the low and high frequency resonances shift towards the higher frequency due to the resultant short electrical length.

Figure 7:
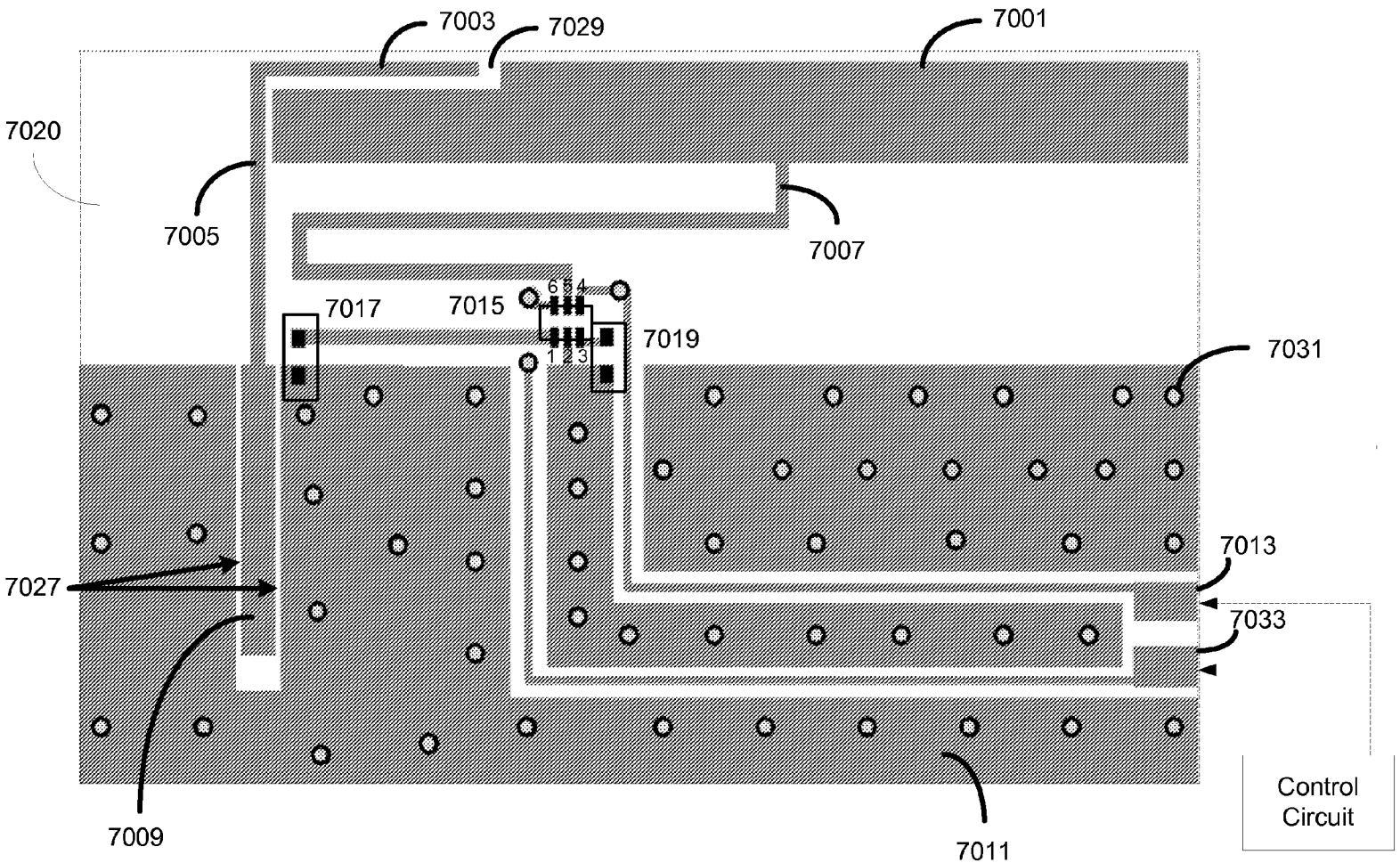
FIGS. 7 and 8 illustrate structures of another exemplary frequency-tunable metamaterial antenna apparatus having a tunable circuit structure.
Figure 8:
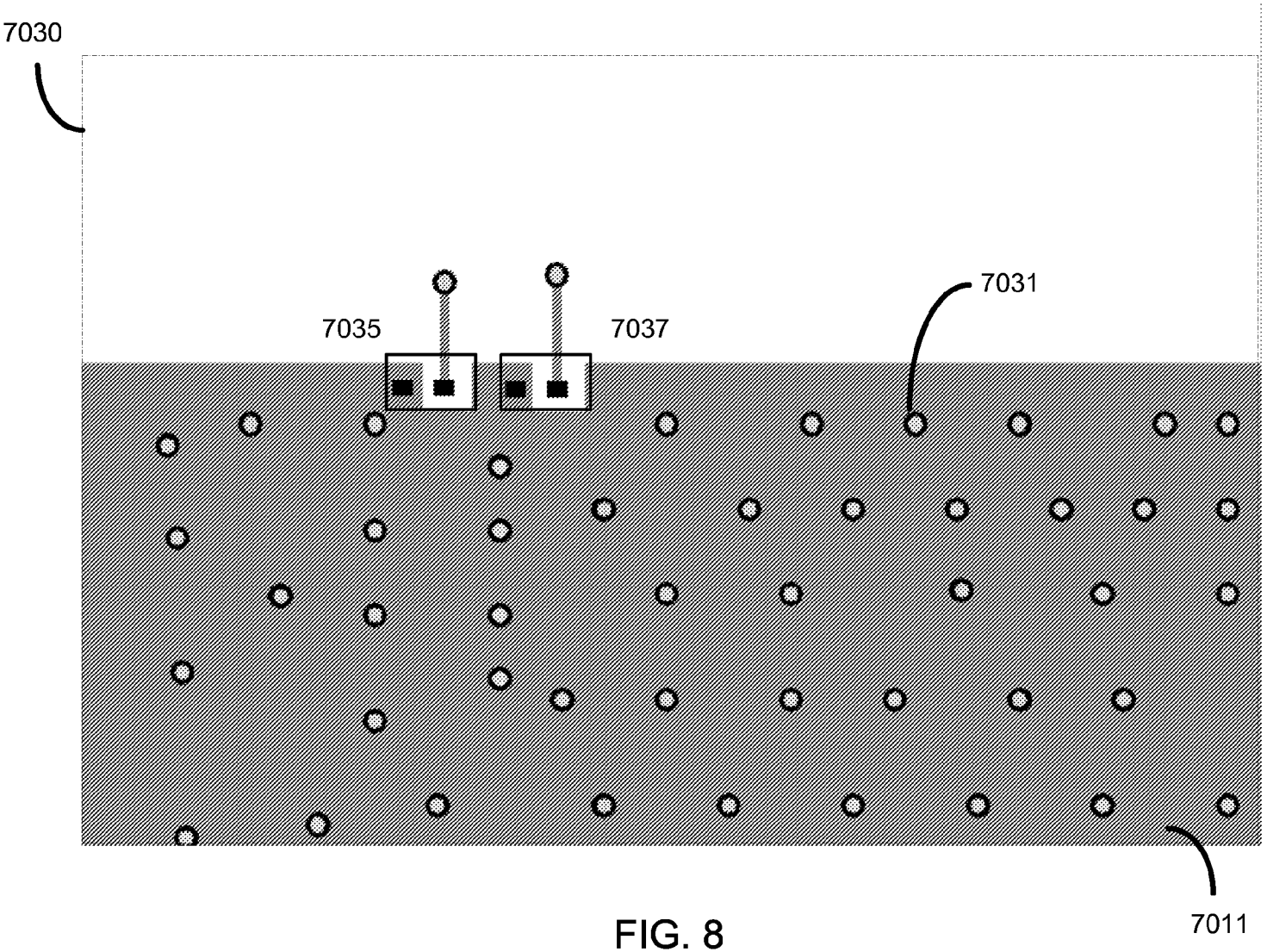

FIGS. 7 and 8 show an example of a multilayer frequency-tunable MTM antenna. FIG. 7 shows the top metal layer of the antenna formed on a substrate and FIG. 8 shows the bottom metal layer. This antenna includes an MTM Cell 7001, a Launch Stub 7003, a Feed Line 7005, a Via Line 7007, a CPW Line 7009 with a given impedance (e.g., 50Ω), and a ground GND 7011. In this multilayer design, the ground GND 7011 has several conductive metal strips that are formed on two sides of the substrate and connected by several via holes 7031 as shown in FIGS. 7 and 8. A description and function of these components are described hereinabove and in Table 1.0.

A switch 7015, such as a SPDT switch, can be used for switching between two segments of the via line 7007. In response to a command sent from a control circuit such as a processor, Vcontrol 7013, which is responsible for controlling the internal connection of the SPDT switch 7015, can assume two values that correspond to a logic low state and a logic high state. When the longer segment is switched ON and coupled to the ground GND 7011 through a capacitor C1 7017, the antenna is tuned to the lower frequency. When the shorter segment is switched ON and coupled to the ground GND 7011 through a capacitor C2 7019, the antenna is tuned to the higher frequency.

As a specific example, listed below are exemplary values of design parameters used for implementing the frequency-tunable MTM antenna with the SPDT switch 7015 shown in FIGS. 7 and 8. The size of the PCB measures about 52 mm in width and 105 mm in length, with a 1 mm thickness. The substrate material can be FR4 with permittivity of about 4.4. The overall height of antenna measures about 10 mm above ground GND 7011, and its total length measures about 36 mm. The grounded CPW line 7009 measures about 1.01 mm wide with 0.2 mm air-gap 7027 on both sides and functions as a 50Ω transmission line for this substrate. The feed line 7005 measures about 8 mm in length and 0.8 mm in width. The launch stub 7003 measures about 8 mm in length and 0.4 mm in width. The MTM cell 7001 measures about 34 mm in length, and 4 mm in width. A 0.2 mm gap 7029 lies between the MTM cell 7001 and the launch stub 7003. The total length of the via line 7007 grounding the MTM cell 7001 measures about 45 mm. The via line 7007 can be bent into a certain shape to achieve a desired length to fit into a limited space as shown in FIG. 7. The SPDT switch 7015 is positioned at about 10 mm from the grounding point of the via line 7007. In this example, a commercially available SPDT switch 7015 such as NEC uPD5713TK, for example, can be used. An input voltage 7033 is provided in this design to feed a Vdd supply voltage of the SPDT switch 7015. Capacitors C1 7017 and C2 7019 are provided as shown and exhibit a low impedance at RF frequencies to provide a connection between the via line 7007 and ground GND 7011. For a DC signal, each capacitor acts as an open circuit which does not interfere with the operation of the SPDT switch 7015. Capacitors C3 7035 and C4 7037 are placed on the bottom layer (FIG. 8) and can be used to reduce the noise on the control line that may come from the processor.

In operation, when the mode of the control signal Vcontrol 7013 is logic high, the switch between pin 5 and pin 1 is OFF and the switch between pin 5 and pin 3 is ON. This mode selects the shorter via line, tuning the antenna to the higher frequency. When the mode of the control signal Vcontrol 7013 is at a logic low state, the switch between pin 5 and pin 1 is ON and the switch between pin 5 and pin 3 is OFF. This mode selects the longer via line, tuning the antenna to the lower frequency.

In an alternative configuration, it is possible to reverse the logic so as to turn ON the switch between pin 5 and 1 at the logic high state, and turn ON the switch between pin 5 and pin 1 at the logic low state. Thus, when the switch between pin 5 and pin 1 at the logic low state, the antenna is tuned to a higher frequency. When the switch between pin 5 and 1 at the logic high state, the antenna is tuned to a lower frequency.

Figure 9:
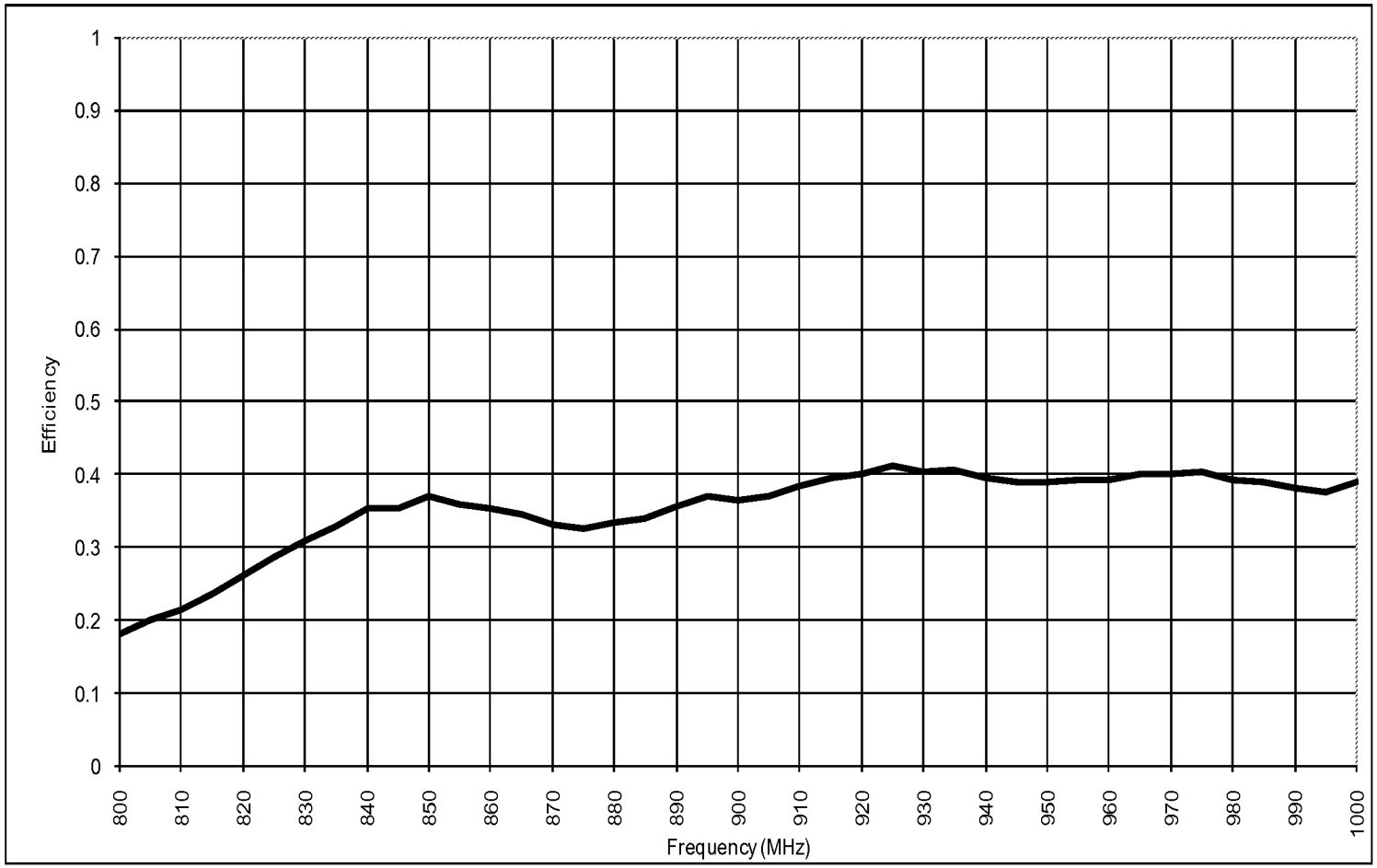
FIG. 9 illustrates a measured efficiency plot in GSM850 and GSM900 for the antenna apparatus of FIGS. 7-8.
Figure 10:
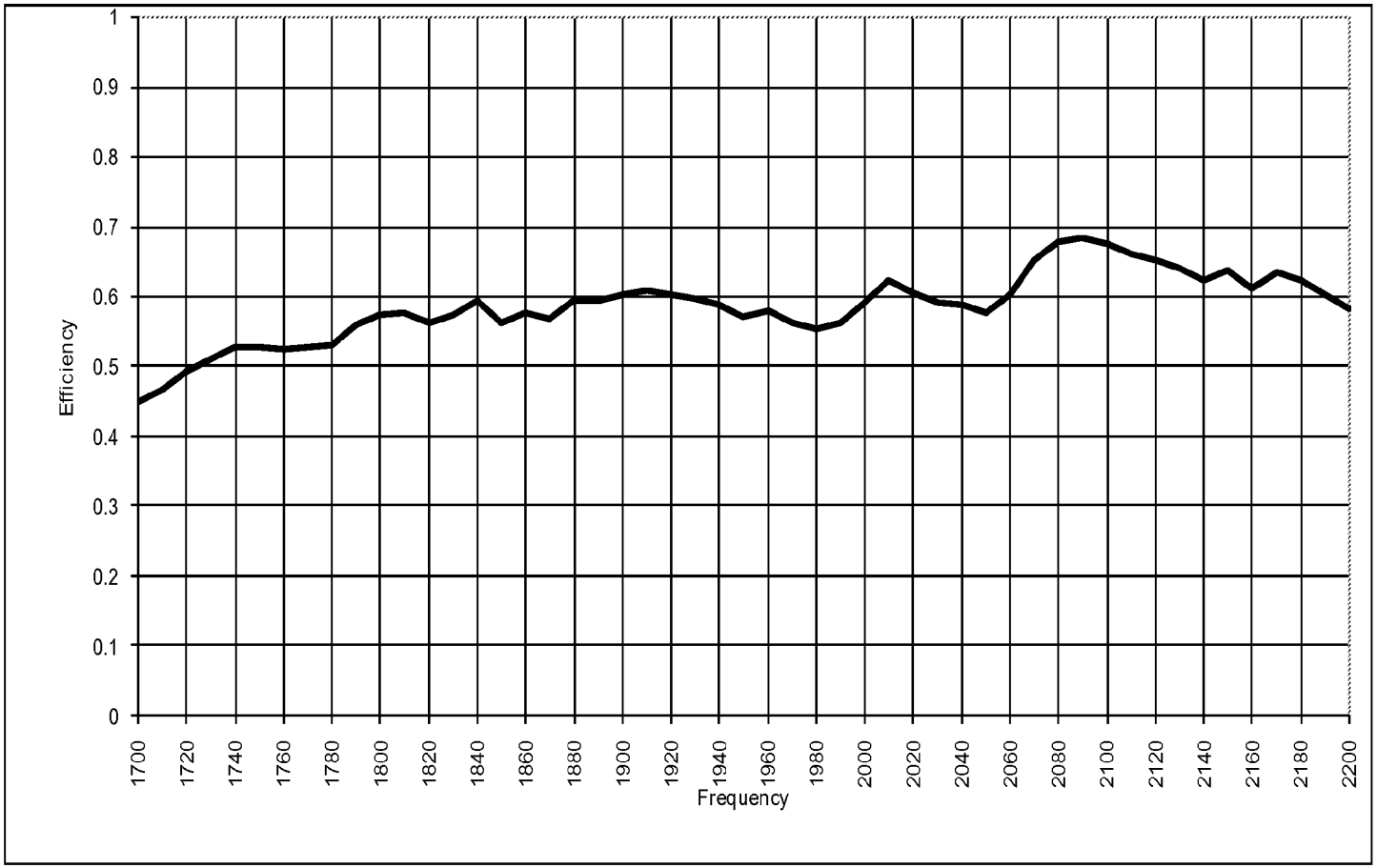
FIG. 10 shows measured efficiency in Digital Cellular System 1800 MHz (DCS1800) and Personal Communications System 1900 MHz (PCS1900) for the antenna apparatus of FIGS. 7 and 8.

The measured efficiency results are shown in FIGS. 9 and 10 for the low band (GSM850 and GSM900) and the high band (DCS1800 and PCS1900), respectively.

In FIG. 9, at above 885 MHz, the switch SPDT 7015 is high (i.e., pin 5-pin 3 connected) and the capacitor C2 7019 provides a connection between the via line 7007 and the ground GND 7011, thereby providing a short via line; and at below 885 MHz, the switch SPDT 7015 is low (i.e., pin 5-pin 1 connected) and the capacitor C1 7017 provides a connection between the via line 7007 and the ground GND 7011, thereby providing a long via line.

FIG. 10 shows measured efficiency in Digital Cellular System 1800 MHz (DCS1800) and Personal Communications System 1900 MHz (PCS1900) for the antenna apparatus of FIGS. 7 and 8. As shown in FIG. 10, at a frequency above 1850 MHz, the switch SPDT 7015 is high and the capacitor C2 7019 provides a connection between the via line 7007 and the ground GND 7011, thereby providing a short via line; and at a frequency below 1850 MHz, the switch SPDT 7015 is low and the capacitor C1 7017 provides a connection between the via line 7007 and the ground GND 7011, thereby providing a long via line.

Figure 11:
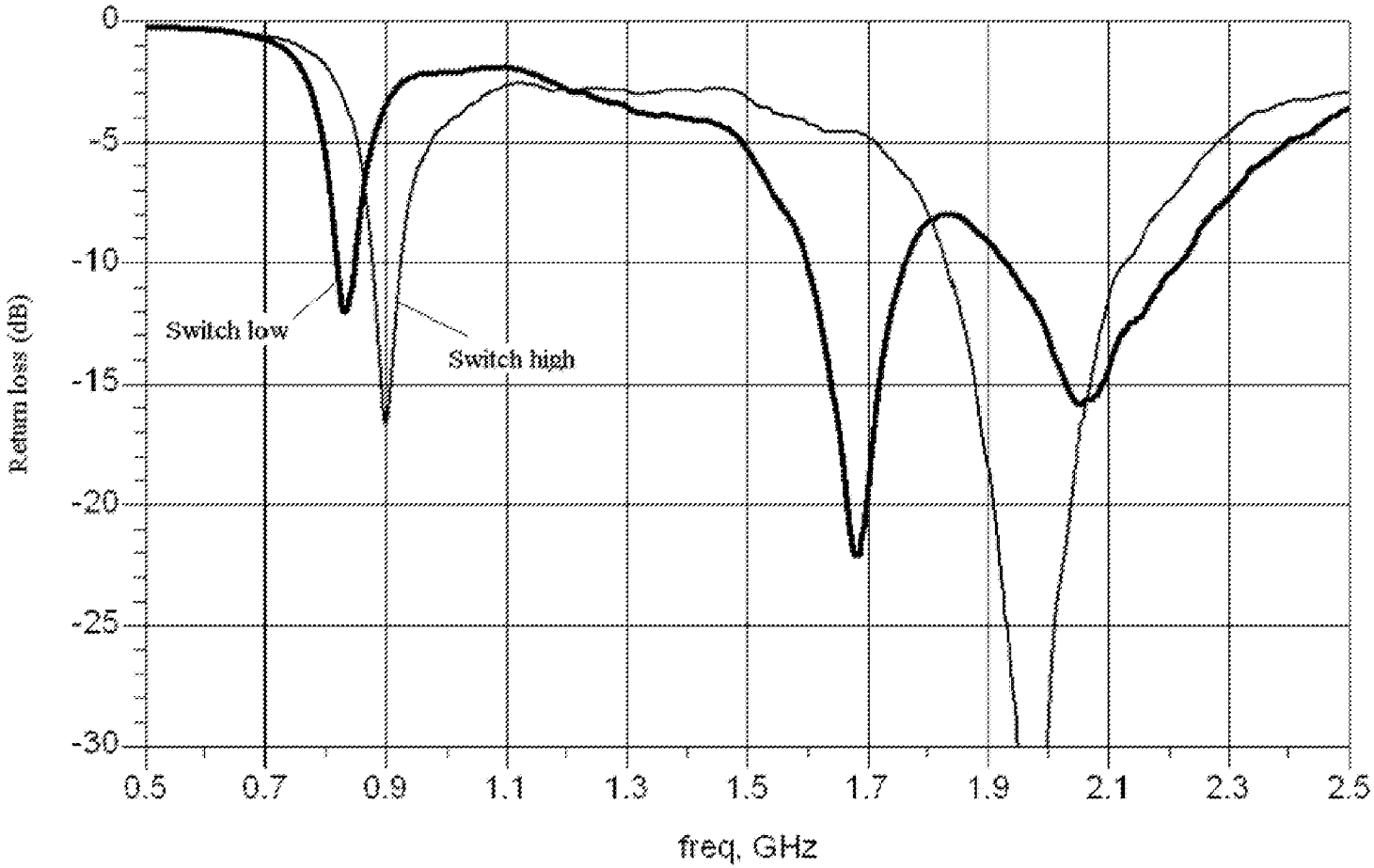
FIG. 11 shows a measured return loss plot for the antenna apparatus of FIGS. 7 and 8.

FIG. 11 shows the measured return loss for a switch SPDT 7015 having a low and high state. The return loss is better than −6 dB in GSM850, GSM900, DCS1800 and PCS1900 bands. When the switch SPDT 7015 is at a low state (i.e., pin 5-pin 1 connected) with the capacitor C1 7017 providing the connection between the via line 7007 and the ground GND 7011, both the low and high frequency resonances shift towards the lower frequency due to the resultant long electrical length. When the switch SPDT 7015 is at a high state (i.e., pin 5-pin 3 connected) with the capacitor C2 7019 providing the connection between the via line 7007 and the ground GND 7007, both the low and high frequency resonances shift towards the higher frequency due to the resultant short electrical length.

Figure 12A:
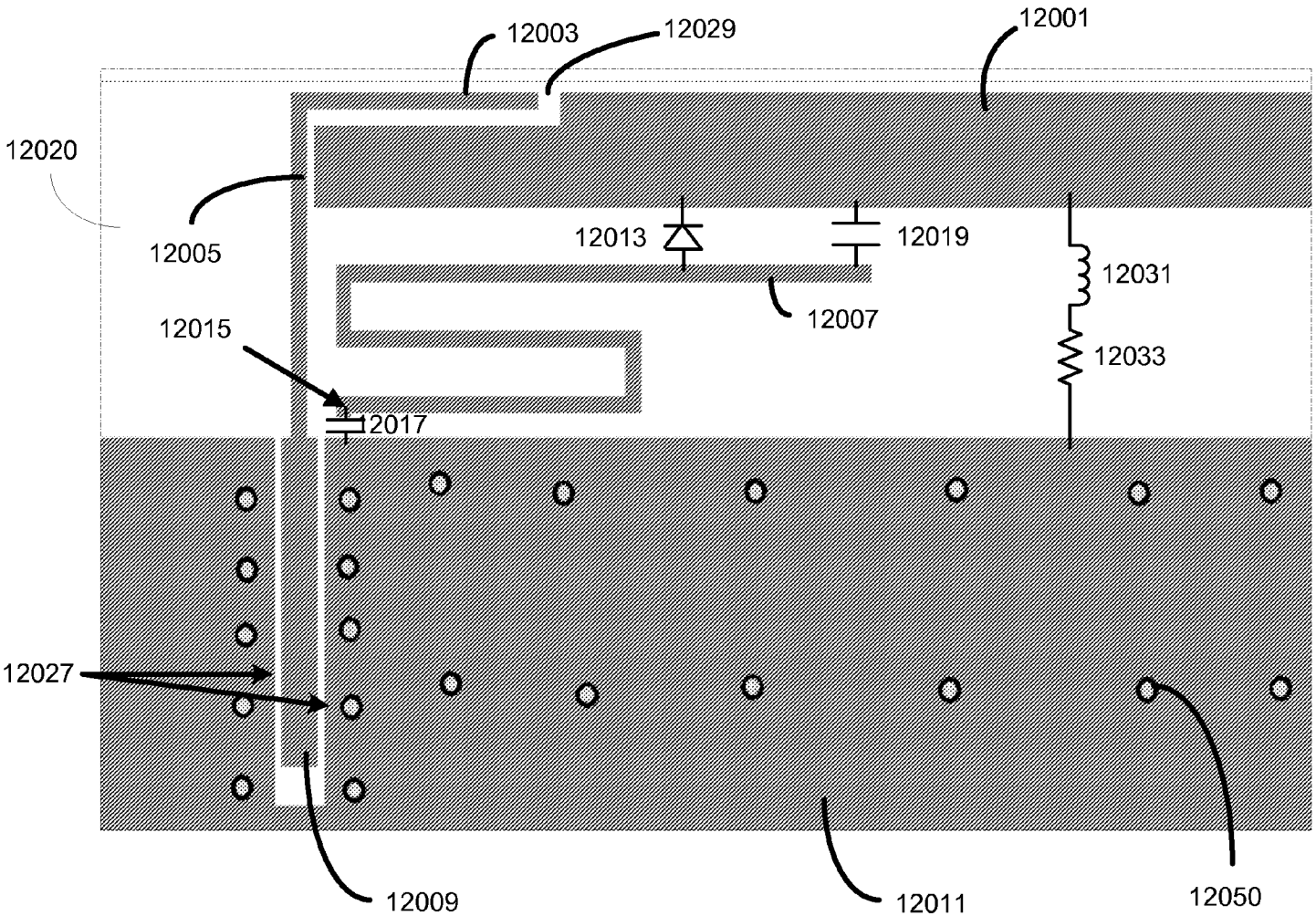
FIGS. 12A and 12B illustrate of yet another exemplary frequency-tunable metamaterial antenna apparatus having a tunable circuit structure.
Figure 12B:
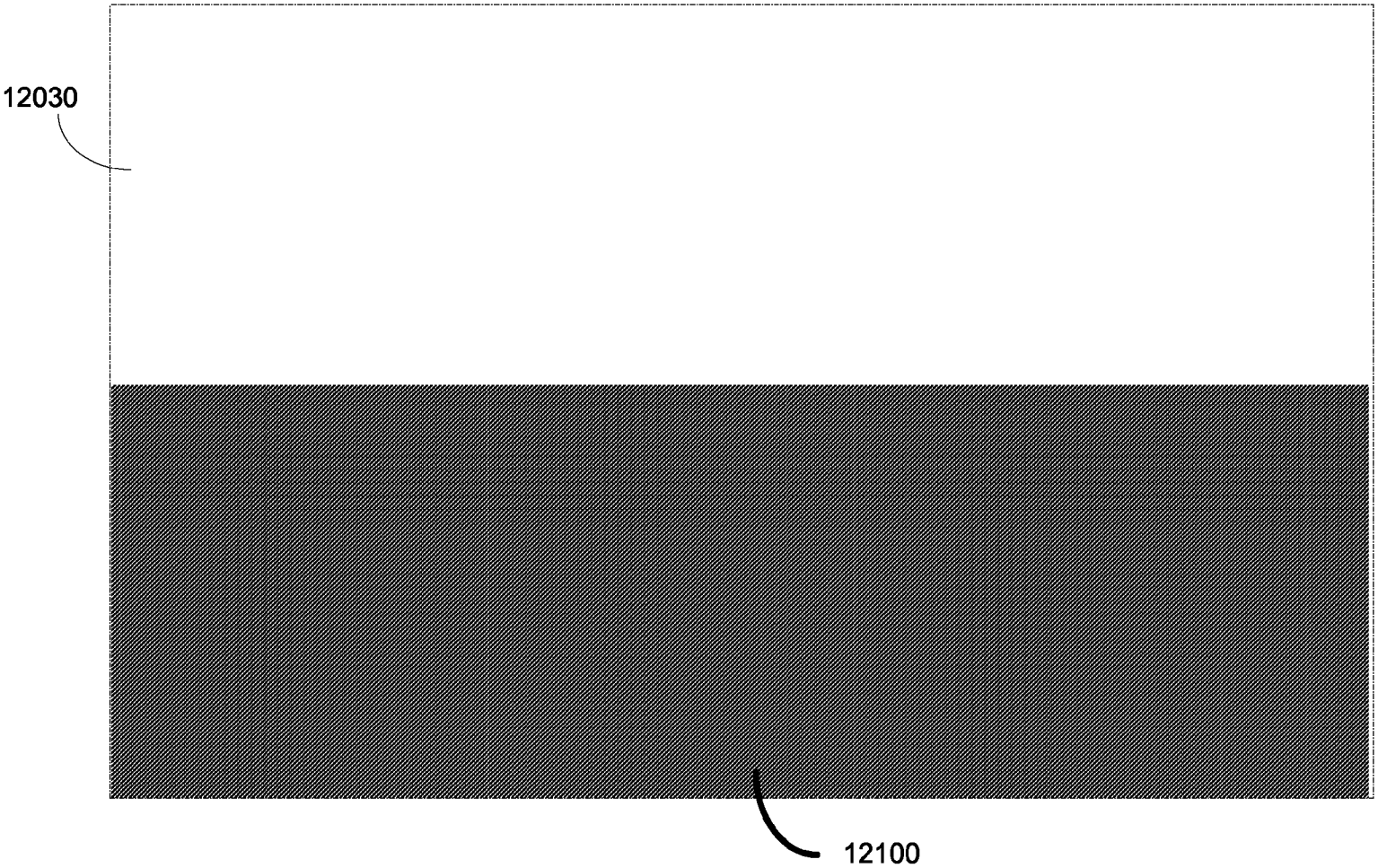

FIGS. 12A-12B illustrates a third embodiment of the frequency-tunable MTM antenna which includes an MTM Cell 12001, a Launch Stub 12003, a Feed Line 12005, a Via Line 12007, a 50Ω CPW Line 12009, a top ground GND 12011, and a bottom ground electrode GND 12100 that is connected to the top ground electrode GND 12011 by an array of vias 12050. A description and function of these components are described hereinabove and in Table 1.0. A PIN diode D1 12013 is positioned near the feed line 12005 of the antenna. In response to a command sent from a control circuit such as a processor, a Vcontrol 12015 can assume two modes that correspond to a logic low state and logic high state, controlling ON/OFF of the PIN diode D1 12013. When the PIN diode D1 12013 is OFF, the MTM cell 12001 follows a long conductive path this is coupled to the longer via line through a capacitor C2 12019 and further coupled to the top ground GND 12011 through a capacitor C1 12017. Thus, for the logic low state, the antenna is tuned to the lower frequency. When the diode 12013 is turned ON, the diode 12013 provides a short conductive path to re-route the via line 12007 to the MTM cell 12001. Relative to the conductive path of capacitor C2 12019, the conductive path of the via line formed by the PIN diode 12013 is moved towards the feed line 12005. This mode results in a shorter via line coupled to the MTM cell 12001 on one end through the forward-biased PIN diode D1 12013 and coupled to the top ground GND 12011 on the other end through the capacitor C1 12017. Thus, for the logic high mode, the antenna is tuned to the higher frequency. Capacitors C1 12017 and C2 12019 are provided as shown and exhibit a low impedance at RF frequencies to provide a connection between the via line 12007 and top ground GND 12011 and act as an open circuit to a DC signal to avoid interfere with the operation of the PIN diode 12013. An RF choke RFC 12031 is connected to the MTM cell 12001 at one end and connected to the top ground GND 12011 through a resistor R1 12033 at the other end. This RFC 12301 exhibits high impedance values at RF frequencies, e.g., in the several hundred ohm range. The function of the RFC 12031 is to isolate the control signal Vcontrol 12015 from the via line 12007. A resistor R1 12033 is used to connect the RFC 12031 to the top ground GND 12011 and to set the magnitude of the current through the PIN diode D1 12013.

As an example, listed below are exemplary values of design parameters used for implementing the frequency-tunable MTM antenna with a PIN diode 12013 switching the via line position as shown in FIG. 12A. The size of the PCB is about 52 mm wide and 105 mm long, with a 1 mm thickness. The substrate material can be FR4 with permittivity of about 4.4. The overall height of antenna is about 10 mm above the top ground GND 12011 and has a total length of about 36 mm. The grounded CPW line 12009 is about 1.01 mm wide with a 0.2 mm air-gap 12027 on both sides and functions as a 50Ω transmission line for this substrate. The feed line 12005 is about 8 mm in length and 0.8 mm in width. The launch stub 12003 measures about 8 mm in length and 0.4 mm in width. The MTM cell 12001 has a length of about 34 mm and a width of about 4 mm. A 0.2 mm gap 10029 lies between the MTM cell 12001 and the launch stub 12003. The total length of the via line 12007 grounding the MTM cell 12001 measures about 45 mm in length. The via line 12007 can be bent into a certain shape to achieve a desired length to fit into a limited space as shown in FIG. 12. The PIN diode D1 12013 is positioned at 8 mm, for example, from the point of connection between the via line 12007 and the MTM cell 12001. In this embodiment, a commercially available PIN diode such as NXP Semiconductor BAP63-3, for example, can be used. When the PIN diode D1 12013 is ON, it has a low resistance of approximately 2Ω. When the PIN diode D1 12013 is OFF, it acts as a small capacitor with a capacitance of approximately 0.4 pF.

Figure 13:
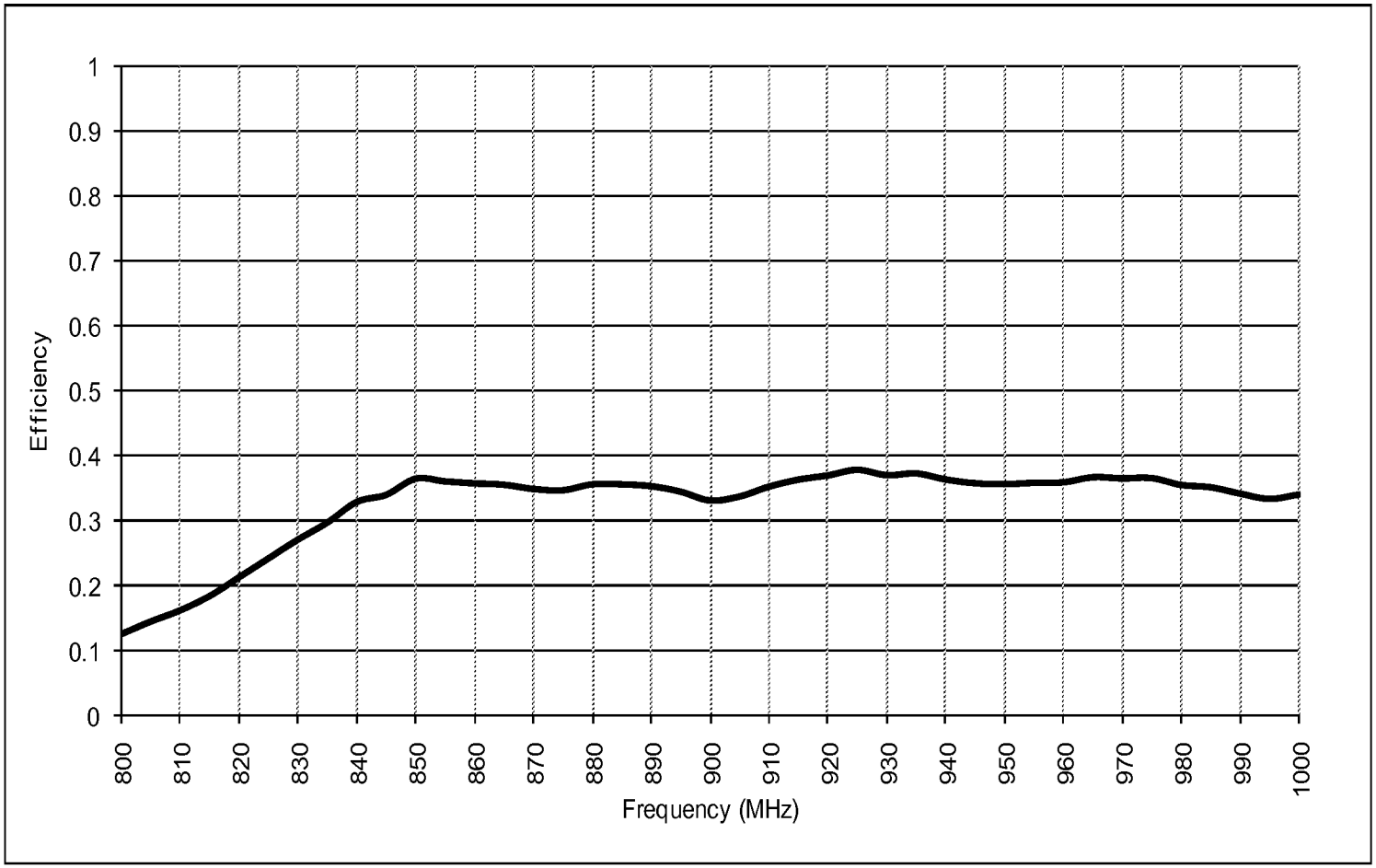
FIG. 13 illustrates a measured efficiency plot in GSM850 and GSM900 for the antenna apparatus of FIG. 12.
Figure 14:
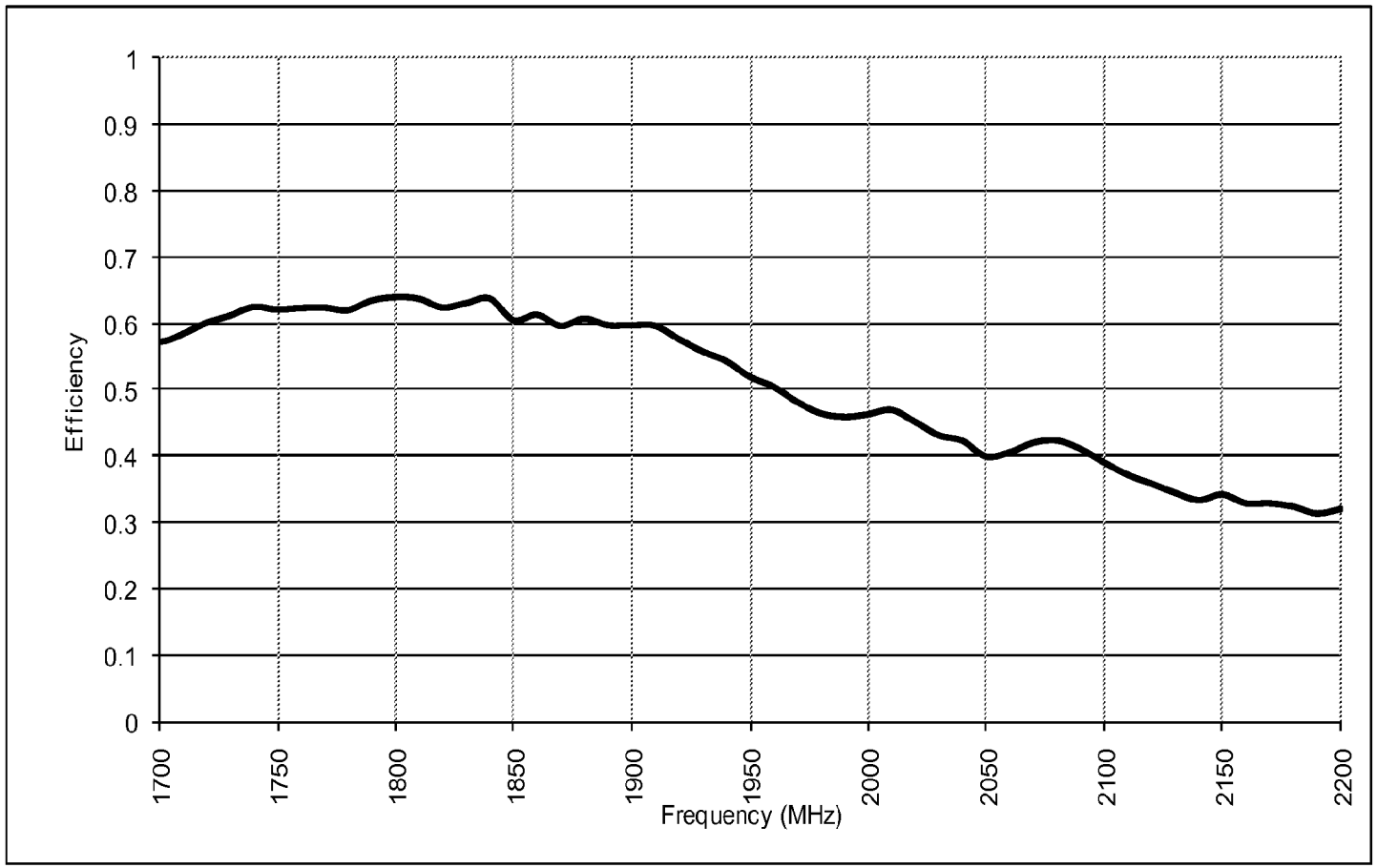
FIG. 14 illustrates a measured efficiency plot in DCS1800 and pcs1900 for the antenna apparatus of FIG. 12.

FIGS. 13 and 14 show measured efficiency results for the low band (GSM850 and GSM900) and the high band (DCS1800 and PCS1900), respectively.

In FIG. 13, at a frequency above 885 MHz, the PIN diode D1 12013 is forward biased, thereby shifting the via line position to provide a short via line; and at a frequency below 885 MHz, the PIN diode D1 12013 is reverse biased and the capacitor C2 12019 provides a connection between the via line 12007 and the MTM cell 12001, thereby shifting the via line position to provide a long via line.

In FIG. 14, at a frequency above 1850 MHz, the PIN diode D1 12013 is forward biased, thereby shifting the via line position to provide a short via line; and at a frequency below 1850 MHz, the PIN diode D1 12013 is reverse biased, and the capacitor C2 12019 provides a connection between the via line 12007 and the MTM cell 12001, thereby shifting the via line position to provide a long via line.

Figure 15:
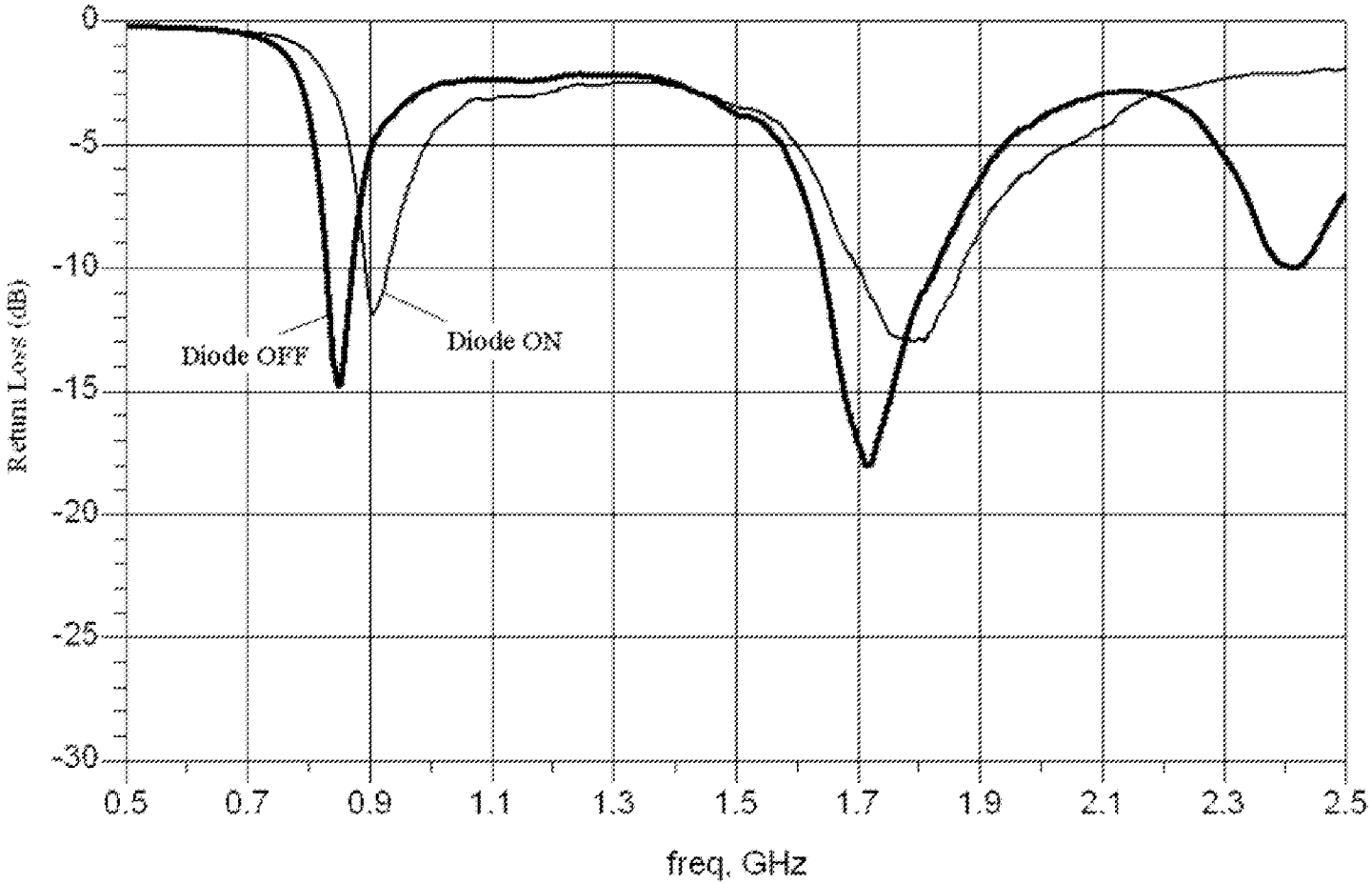
FIG. 15 illustrates a measured return loss plot for the antenna apparatus of FIG. 12.

FIG. 15 shows the measured return loss for the cases of the PIN diode D1 12013 being ON and OFF. The return loss is better than −6 dB in GSM850, GSM900, DCS1800 and PCS1900 bands. When the PIN diode D1 12013 is OFF (reverse biased) with the capacitor C2 12019 providing a connection between the via line 12007 and the top ground GND 12011, both the low and high frequency resonances shift towards the lower frequency due to the resultant long electrical length. When the PIN diode D1 12013 is ON (forward biased) providing a connection between the via line 12007 and the top ground GND 12011, both the low and high frequency resonances shift towards the higher frequency due to the resultant short electrical length.

In addition to changing the electrical length for the path connecting the CRLH antenna to the ground electrode, the dimension of the CRLH MTM antenna can also be made adjustable by the tuning circuit to change the effective electrical length of the electrical coupling between the CRLH MTM antenna and the ground electrode to change the operating frequency of the CRLH MTM antenna.

Figure 16A:
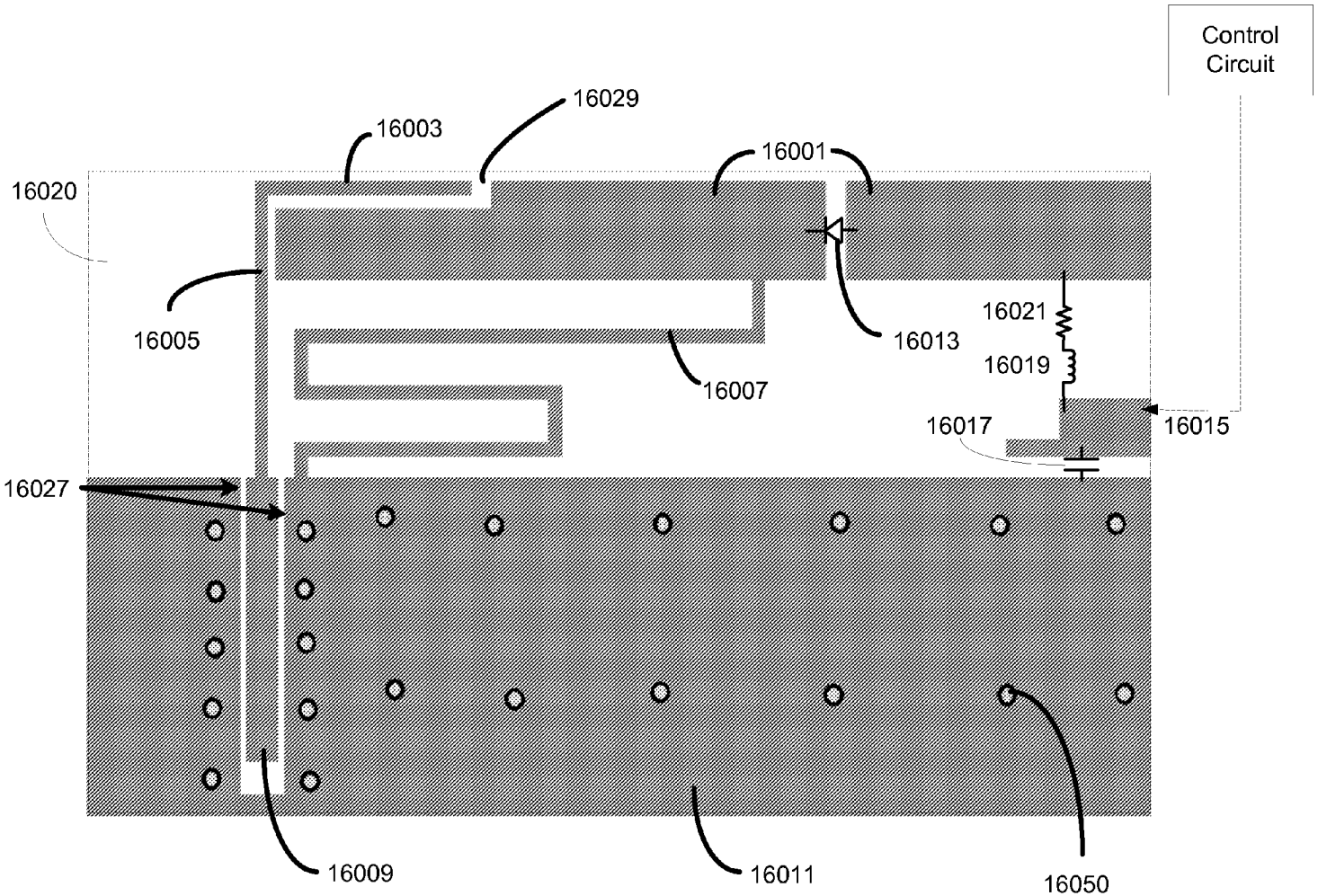
FIGS. 16A and 16B illustrate the top and bottom layers, respectively, of an example of a frequency-tunable metamaterial antenna apparatus having two MTM cell segments interconnected by a switch.
Figure 16B:
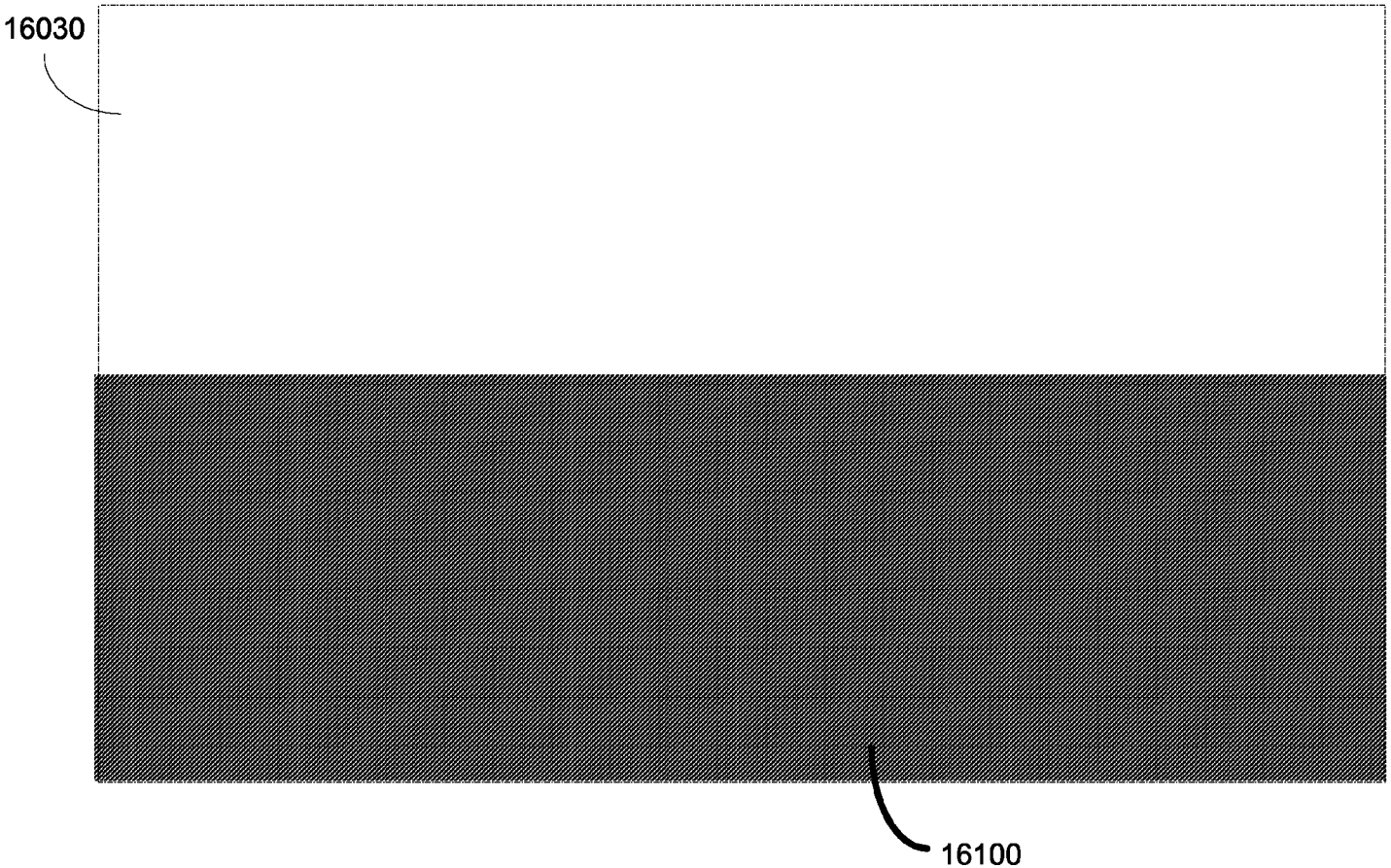

FIG. 16A-B illustrates an example of a frequency-tunable MTM antenna by implementing an adjustable antenna and controlling the dimension of the adjustable antenna. This antenna includes an MTM Cell 16001, a Launch Stub 16003, a Feed Line 16005, a Via Line 16007, a CPW Line 16009 with a desired impedance (e.g., 50Ω), a top ground GND 16011, and a bottom ground electrode GND 16100 that is connected to the top ground electrode GND 16011 by an array of vias 16050. A description and function of these components are described hereinabove and in Table 1.0. A PIN diode D1 16013 is used to switch the MTM cell 16001 length. In response to a command sent from a control circuit such as a processor, Vcontrol 16015 assumes two states that correspond to a logic low state and a logic high state, controlling ON/OFF of the PIN diode D1 16013. When the PIN diode D1 16013 is OFF, the MTM cell 16001 is electrically shorter, and thus the antenna is tuned to the higher frequency. When the diode 16013 is ON, the MTM cell 16001 is electrically longer, and thus the antenna is tuned to the lower frequency. A capacitor C1 16017 is used to connect the Vcontrol 16015 to the top ground GND 16011 and exhibits a low impedance value at RF frequencies to provide filtering on the control line. An RF choke RFC 16019 is used to connect one portion of the MTM cell 16001 to the Vcontrol 16015 through a resistor R1 16021. The RFC 16019 can exhibit high impedance values (e.g., in the several hundred ohm range) at RF frequencies. The RFC 16019 can be used to isolate the control signal Vcontrol 16015 from the via line 16007. A resistor R1 16021 is provided to connect the RFC 16019 to one portion of the MTM cell 16001 and to set the magnitude of the current through the PIN diode D1 16013.

As a specific example, listed below are exemplary values of design parameters used for implementing the frequency-tunable MTM antenna with a PIN diode 16013 switching the MTM cell 16001 length as shown in FIG. 16. The size of the PCB is about 52 mm in width and 105 mm in length, with a 1 mm thickness. The substrate material can be FR4 with permittivity of 4.4. The overall height of antenna is about 10 mm above the top ground GND 16011 and has total length of about 36 mm. The grounded CPW line 16009 is about 1.01 mm wide with a 0.2 mm air-gap 16027 on both sides and functions as a 50 ohm transmission line for this substrate. The feed line 16005 is about 8 mm in length and 0.8 mm in width. The launch stub 16003 is about 8 mm long and 0.4 mm wide. The MTM cell 16001 has a length of about 34 mm and a width of 4 mm. A 0.2 mm gap 16029 lies between the MTM cell 16001 and the launch stub 16003. The total length of the via line 16007 grounding the MTM cell 16001 is about 46 mm. The via line can be bent into a certain shape to achieve a desired length to fit into a limited space as shown in FIG. 16A. The PIN diode D1 16013 is positioned at about 10 mm from the end of the MTM cell 16001. In this embodiment, a commercially available PIN diode such as NXP Semiconductor BAP63-3, for example, can be used. When the PIN diode D1 16013 is ON, it has a low resistance measuring approximately 2Ω. When the PIN diode D1 16013 is OFF, it acts as a small capacitor having a capacitance measuring approximately 0.4 pF.

Figure 16C:
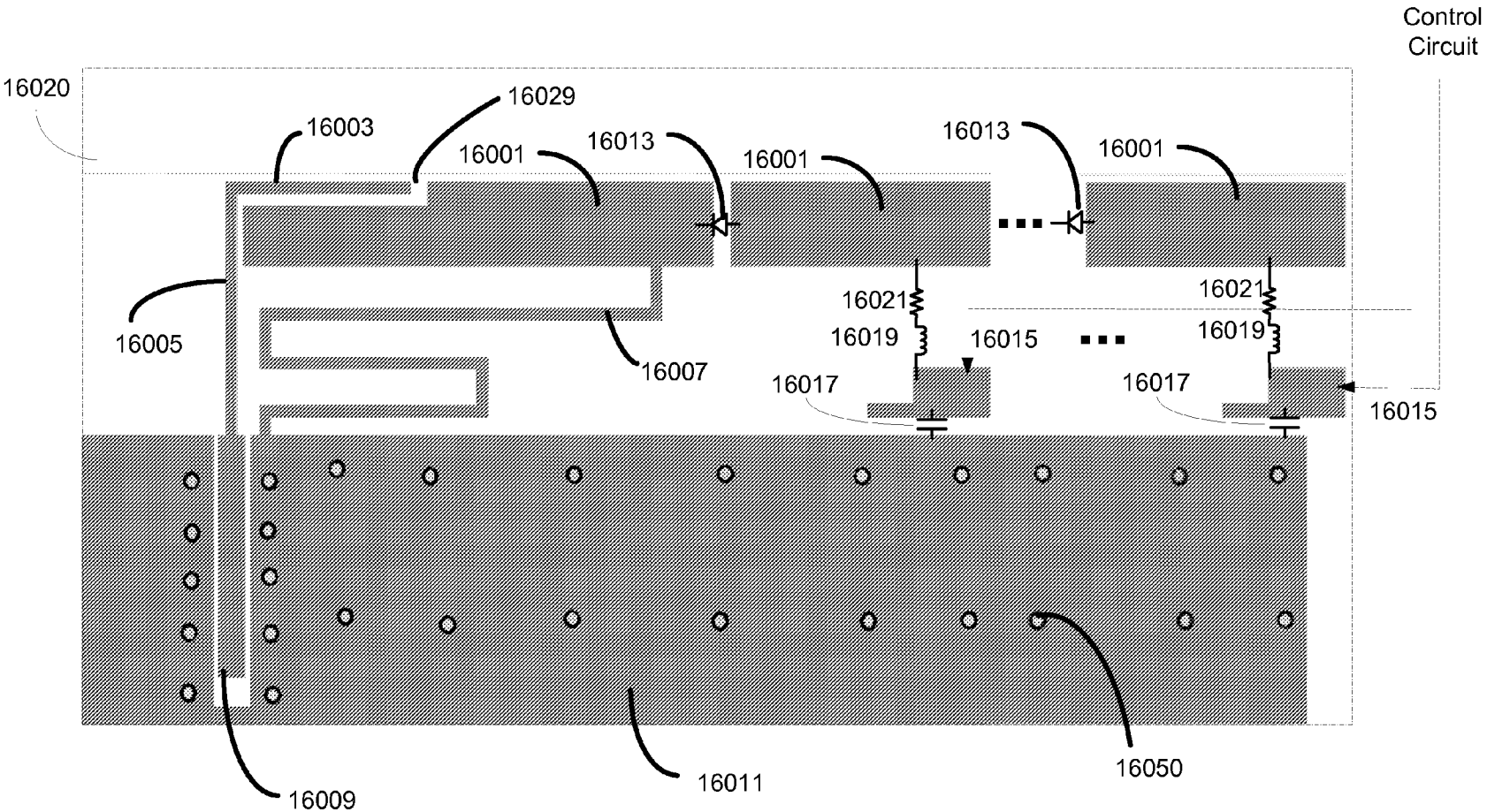
FIG. 16C illustrates a top layer of a frequency-tunable metamaterial antenna apparatus having an array of MTM cells coupled in series via switches.

The frequency-tunable MTM antenna of FIG. 16A can be configured to have an array of MTM cells coupled in series by diode 16013 as shown in FIG. 16C. In this design, additional components such as the control signal Vcontrol 16015, capacitor C1 16017, RFC 16019, resistor R1 16021 are added for each MTM cell 16001 included in the array. In operation, each diode 16013 associated with each MTM cell can be turned on independently which results in a total MTM cell electrical length that is dependent on the state of each diode. Thus, when diode 16013 is turned on for every MTM cell in the array, the total electrical length is at its longest length. Conversely, when diode 16013 is turned off for every MTM cell, the total electrical length is at its smallest length. Other electrical lengths are obtained when only a partial set of diodes 16013 are turned on or off.

Figure 17:
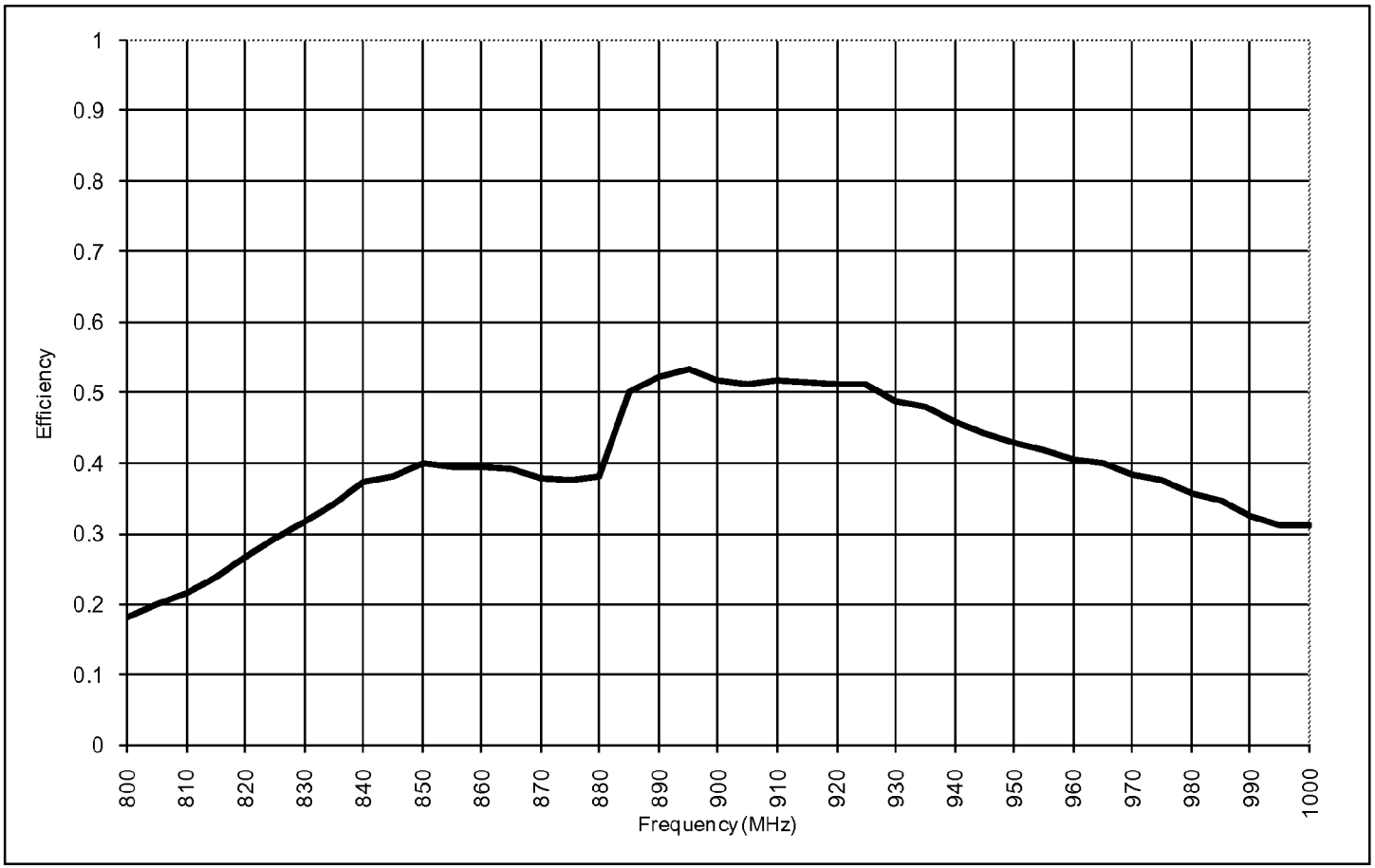
FIG. 17 illustrates a measured efficiency plot in GSM850 and GSM900 for the antenna apparatus of FIG. 16.
Figure 18:
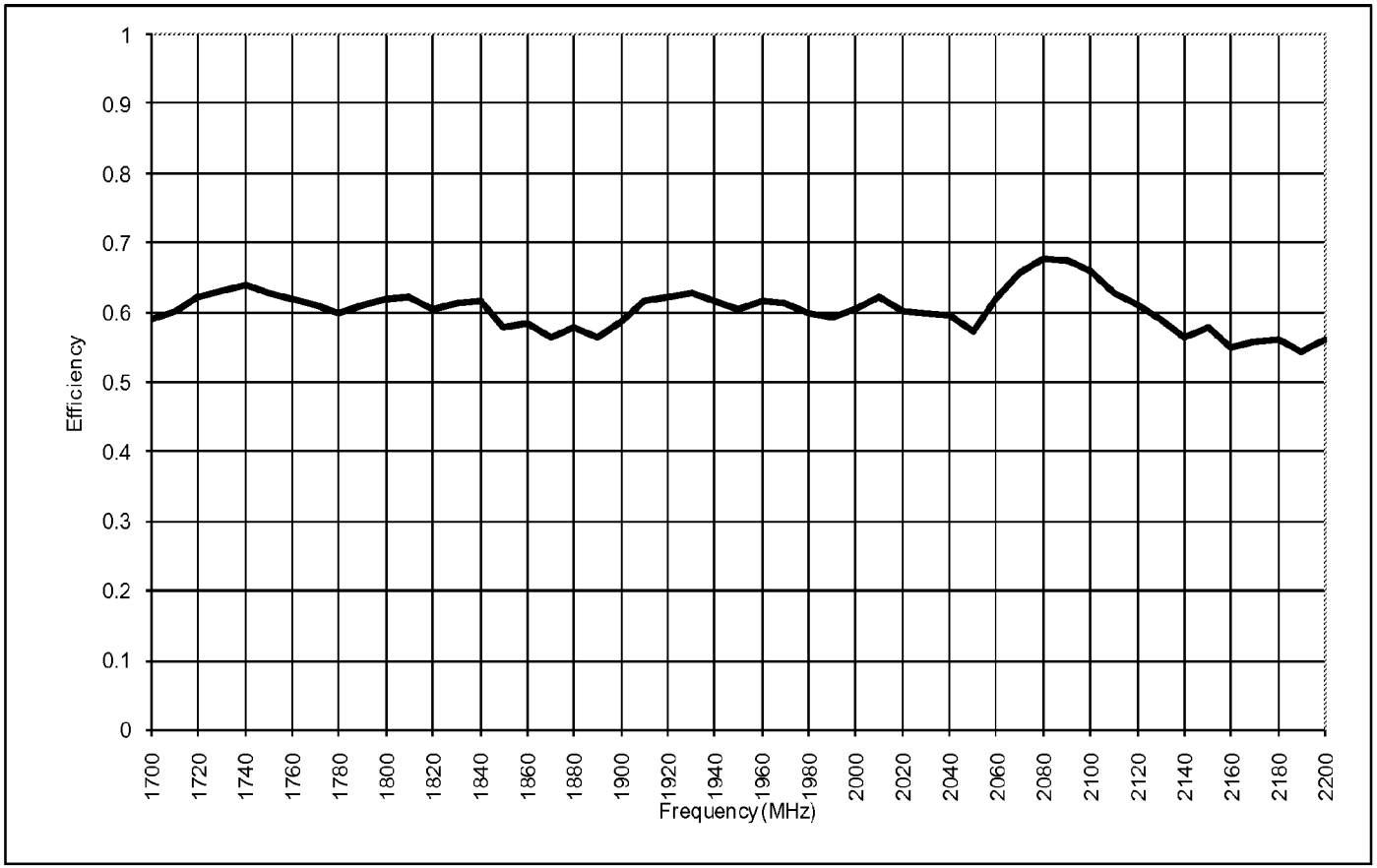
FIG. 18 illustrates a measured efficiency plot in DCS1800 and PCS1900 for the antenna apparatus of FIG. 16.

FIGS. 17 and 18 show measured efficiency results for the low band (GSM850 and GSM900) and the high band (DCS1800 and PCS1900), respectively. In FIG. 17, at a frequency above 880 MHz, the PIN diode D1 16013 is reverse biased, thereby providing a short MTM cell 16001 length; and at a frequency below 880 MHz, the PIN diode D1 16013 is forward biased, thereby providing a long MTM cell 16001 length. In FIG. 18, at a frequency above 1850 MHz, the PIN diode D1 16013 is reverse biased, thereby providing a short via line; and at a frequency below 1850 MHz, the PIN diode D1 16013 is forward biased, thereby providing a long via line.

Figure 19:
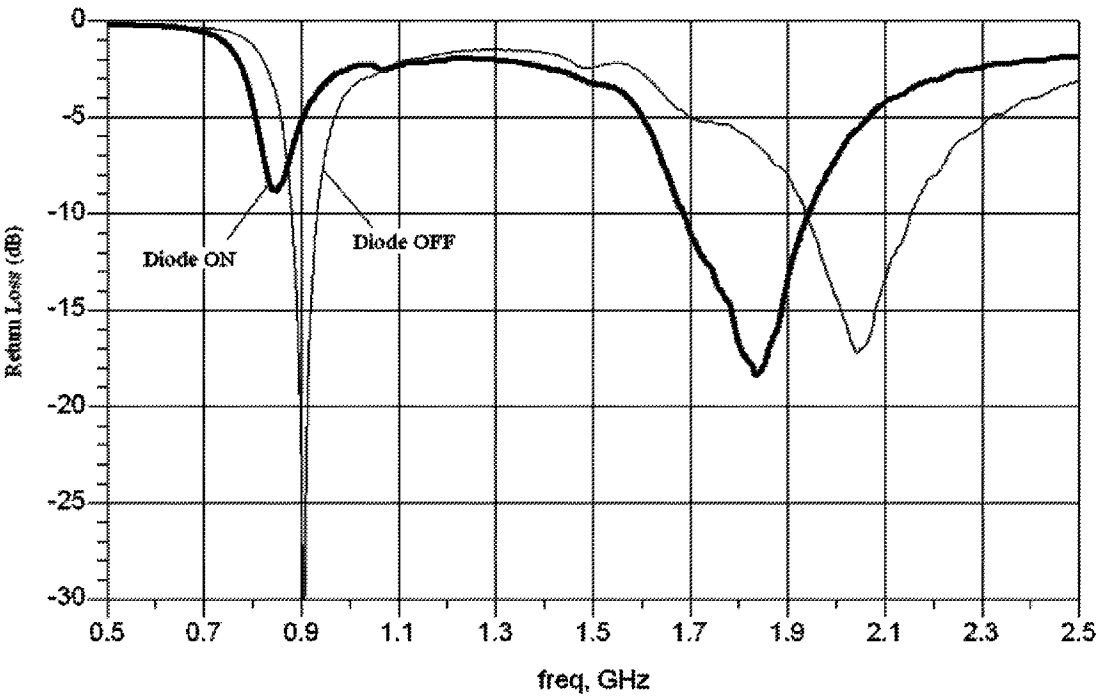
FIG. 19 illustrates a measured return loss plot for the antenna apparatus of FIG. 16.

FIG. 19 shows measured return loss for the cases of the PIN diode D1 16013 being ON and OFF. In FIG. 19, the return loss is better than −6 dB in GSM850, GSM900, DCS1800 and PCS1900 bands. When the PIN diode D1 16013 is ON (forward biased) providing a long MTM cell 16001 length, both the low and high frequency resonances shift towards the lower frequency due to the resultant long electrical length. When the PIN diode D1 16013 is OFF (reverse biased) providing a short MTM cell 16013 length, both the low and high frequency resonances shift towards the higher frequency due to the resultant short electrical length.

Several examples of the frequency-tunable MTM antennas that cover multiple disconnected or connected frequency bands are described. The present implementations can be extended to various applications. For example, the above structures can be extended to switch among more than two bands by using switches such as switches with a single pole and three or more throws, SPNT where N is a positive integer greater than 2). Such a switch can be used to tune to three or more bands by switching the electrical coupling between the CRLH MTM antenna and the ground electrode between three or more different electrical paths of different electrical lengths. Examples include an SP3T switch for tuning the antenna to operate at three frequency bands by switching to effectuate three different electrical paths corresponding to three different frequency bands and a SPOT switch for tuning the antenna to operate at four frequency bands by switching to effectuate three different electrical paths corresponding to four different frequency bands. Similarly, two or more diodes can be used to switch among multiple bands. One or more varactors can be used for the same purpose. In the above structures, the diodes and switches can be replaced with tunable inductors or capacitors, to achieve wide frequency tuning possible within the dynamic range of the devices. Moreover, features disclosed in the above structures can be used in combinations to tune the antenna to different bands. For example, the lengths of the cell and the via can be varied at the same time.

Figure 20:
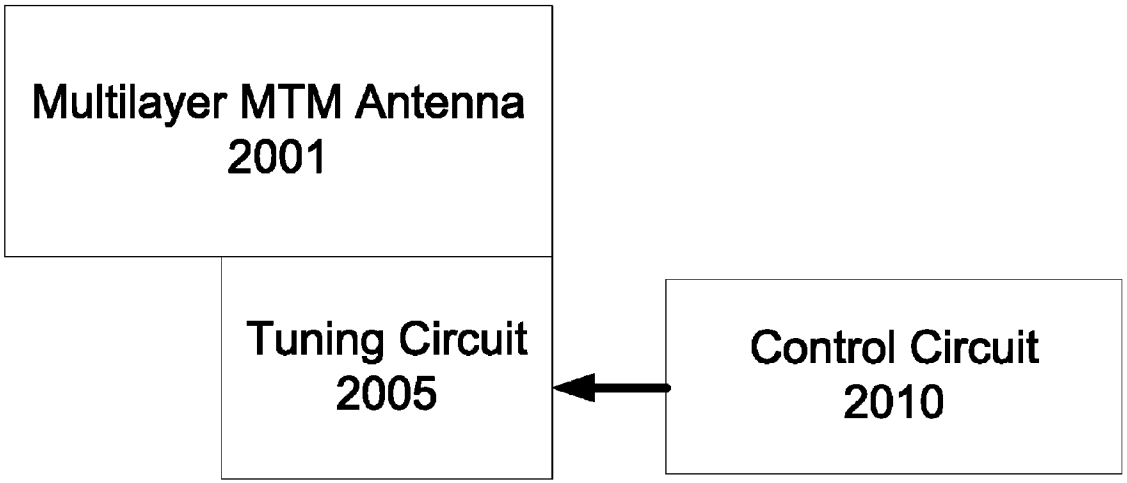
FIG. 20 shows an example of a multilayer frequency-tunable MTM antenna apparatus.

Frequency-tunable MTM antennas in this document can be implemented as MTM structures having two or more metallization layers that forming components of the MTM antennas. FIG. 20 illustrates an example of a multilayer frequency tunable MTM antenna having a tuning circuit that tunes the antenna frequencies. This antenna includes a multilayer MTM antenna 2001, a tuning circuit 2005 having two or more conductive paths which are of different electrical lengths and are connected to the multilayer MTM antenna 2001 and; and a control circuit 2010 connected to the tuning circuit 2005 for selecting an electrical length defined by one of the conductive paths. Such a multilayer frequency tunable MTM antenna with multiple conductive elements is configured to generate two or more frequency resonances. The tuning circuit 2005 includes one or more switching components that are connected to the conductive elements. Each conductive element can vary in shape, length, and width, thereby defining a particular electrical length. Thus, for each electrical length that is formed, a corresponding frequency resonance is produced. These components can be selectively switched "ON" and "OFF", as controlled by the control circuit 2010, to tune to the operating antenna frequency amongst these different antenna resonances as defined by the selected conductive elements. These switching components can include devices such as but not limited to pin diodes, capacitors, and SPDT, SP3T, SPOT, or SPNT switches.

Examples of suitable MTM structures having two or more metallization layers for the design in FIG. 20 are MTM structures in this document and other MTM structures. For example, multilayer metallization metamaterial structures described in U.S. patent application Ser. No. 12/270,410 filed on Nov. 13, 2008 and entitled "Metamaterial Structures with Multilayer Metallization and Via" can be used to implement the design in FIG. 20. The entire disclosure of the application Ser. No. 12/270,410 is incorporated by reference as part of the disclosure of this document.

The application Ser. No. 12/270,410 discloses techniques and apparatus based on metamaterial structures for antenna and transmission line devices, including multilayer metallization metamaterial structures with one or more conductive vias connecting conductive parts in two different metallization layers. In one aspect, a metamaterial device is provided to include a substrate, a plurality of metallization layers associated with the substrate and patterned to have a plurality of conductive parts, and a conductive via formed in the substrate to connect a conductive part in one metallization layer to a conductive part in another metallization layer. The conductive parts and the conductive via form a composite right and left handed (CRLH) metamaterial structure. In one implementation of the device, the conductive parts and the conductive via of the CRLH metamaterial structure are structured to form a metamaterial antenna and are configured to generate two or more frequency resonances. In another implementation, two or more frequency resonances of the CRLH metamaterial structure are sufficiently close to produce a wide band. In another implementation, the parts and the conductive via of the CRLH metamaterial structure are configured to generate a first frequency resonance in a low band and a second frequency resonance in a high band, the first frequency resonance being a left-handed (LH) mode frequency resonance and the second frequency resonance being a right-handed (RH) mode frequency resonance. In yet another implementation, the parts and the conductive via of the CRLH metamaterial structure are configured to generate a first frequency resonance in a low band, a second frequency resonance in a high band, and a third frequency resonance which is substantially close in frequency to the first frequency resonance to be coupled with the first frequency resonance, providing a combined mode resonance band that is wider than the low band. In another aspect, a metamaterial device is provided to include a substrate, a first metallization layer formed on a first surface of the substrate and patterned to comprise a cell patch and a launch pad that are separated from each other and are electromagnetically coupled to each other, and a second metallization layer formed on a second surface of the substrate parallel to the first surface and patterned to comprise a ground electrode located outside a footprint of the cell patch, a cell via pad located underneath the cell patch, a cell via line connecting the ground electrode to the cell via pad, an interconnect pad located underneath the launch pad, and a feed line connected to the interconnect pad. This device also includes a cell via formed in the substrate to connect the cell patch to the cell via pad and an interconnect via formed in the substrate to connect the launch pad to the interconnect pad. One of the cell patch and the launch pad is shaped to include an opening and the other of the cell patch and the launch pad is located inside the opening. The cell patch, the cell via, the cell via pad, the cell via line, the ground electrode, the launch pad, the interconnect via, the interconnect via and the feed line form a composite right and left handed (CRLH) metamaterial structure. In another aspect, a wireless communication device includes a printed circuit board (PCB) comprising a portion that is structured to form an antenna. The antenna includes a CRLH metamaterial cell comprising a top metal patch on a first surface of the PCB, a bottom metal pad on a second, opposing surface of the PCB and a conductive via connecting the top metal patch and the bottom metal pad; and a grounded co-planar waveguide (CPW) formed on the top surface of the PCB at a location to be spaced from the CRLH metal material cell and comprising a planar waveguide (CPW) feed line, a top ground (GND) around the CPW feed line. The CPW feed line has a terminal located close to and capacitively coupled to the top metal patch of the CRLH metamaterial cell. The antenna also includes a bottom ground metal patch formed on the bottom surface of the PCB below the grounded CPW formed on the top surface of the PCB; and a bottom conductive path that connects the bottom ground metal path to the bottom metal pad of the CRLH metamaterial cell. In one implementation, the antenna is configured to have two or more resonances in different frequency bands, which may, for example, include a cellular band from 890 MHz to 960 MHz and a PCS band from 1700 MHz to 2100 MHz. In yet another aspect, a wireless communication device includes a printed circuit board (PCB) comprising a portion that is structured to form an antenna. This antenna includes a CRLH metamaterial cell comprising a top metal patch on a first surface of the PCB; a grounded co-planar waveguide (CPW) formed on the top surface of the PCB at a location to be spaced from the CRLH metal material cell and comprising a planar waveguide (CPW) feed line, a top ground (GND) around the CPW feed line, wherein the CPW feed line has a terminal located close to and capacitively coupled to the top metal patch of the CRLH metamaterial cell; and a top ground metal path formed on the top surface of the PCB to connect to the top ground and the top metal patch of the CRLH metamaterial cell. In one implementation, the antenna is configured to have two or more resonances in different frequency bands, which may, for example, include a cellular band from 890 MHz to 960 MHz and a PCS band from 1700 MHz to 2100 MHz.

In addition, frequency-tunable MTM antennas in this document can be implemented as MTM structures in non-planar configurations. Such non-planar MTM antenna structures arrange one or more antenna sections of an MTM antenna away from one or more other antenna sections of the same MTM antenna so that the antenna sections of the MTM antenna are spatially distributed in a non-planar configuration to provide a compact structure adapted to fit to an allocated space or volume of a wireless communication device, such as a portable wireless communication device. For example, one or more antenna sections of the MTM antenna can be located on a dielectric substrate while placing one or more other antenna sections of the MTM antenna on another dielectric substrate so that the antenna sections of the MTM antenna are spatially distributed in a non-planar configuration such as an L-shaped antenna configuration. In various applications, antenna portions of an MTM antenna can be arranged to accommodate various parts in parallel or non-parallel layers in a three-dimensional (3D) substrate structure. Such non-planar MTM antenna structures may be wrapped inside or around a product enclosure. The antenna sections in a non-planar MTM antenna structure can be arranged to engage to an enclosure, housing walls, an antenna carrier, or other packaging structures to save space. In some implementations, at least one antenna section of the non-planar MTM antenna structure is placed substantially parallel with and in proximity to a nearby surface of such a packaging structure, where the antenna section can be inside or outside of the packaging structure. In some other implementations, the MTM antenna structure can be made conformal to the internal wall of a housing of a product, the outer surface of an antenna carrier or the contour of a device package. Such non-planar MTM antenna structures can have a smaller footprint than that of a similar MTM antenna in a planar configuration and thus can be fit into a limited space available in a portable communication device such as a cellular phone. In some non-planar MTM antenna designs, a swivel mechanism or a sliding mechanism can be incorporated so that a portion or the whole of the MTM antenna can be folded or slid in to save space while unused. Additionally, stacked substrates may be used with or without a dielectric spacer to support different antenna sections of the MTM antenna and incorporate a mechanical and electrical contact between the stacked substrates to utilize the space above the main board.

Figure 21:
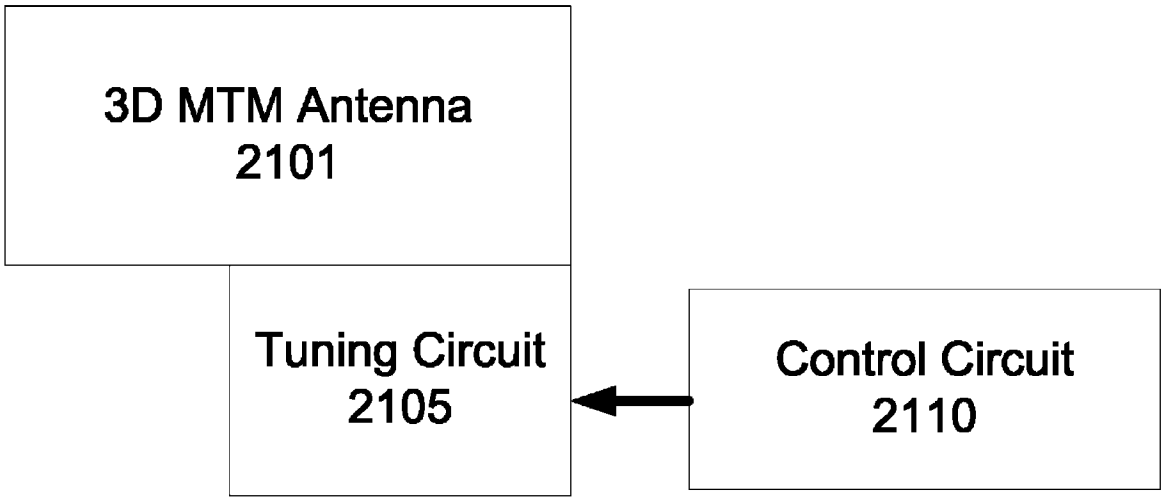
FIG. 21 shows an example of a 3D frequency-tunable MTM antenna apparatus.

FIG. 21 shows an example of a frequency-tunable MTM antenna device in a 3D metallization metamaterial structure. This 3D frequency tunable MTM antenna device includes a 3D MTM antenna 2101; a tuning circuit 2105 having one or more conductive paths which are connected to the 3D MTM antenna 2101 and define one or more electrical lengths; and a control circuit 2110 connected to the tuning circuit 2105 for selecting an electrical length defined by one of the conductive paths. The 3D frequency tunable MTM antenna includes multiple conductive elements that are configured to generate two or more frequency resonances. The tuning circuit 2105 includes one or more switching components that are connected to the conductive elements. Each conductive element can vary in shape, length, and width, thereby defining a given electrical length. Thus, for each electrical length that is formed, a corresponding frequency resonance is produced. By switching these components "ON" and "OFF", as controlled by the control circuit 2110, the resulting frequency resonances produced by the antenna can be tuned to two or more frequency resonances as defined by the selected conductive elements. These switching components can include devices such as but not limited to pin diodes, capacitors, and SPDT, SP3T, SP4T, or SPNT switches.

Non-planar, 3D MTM antennas in FIG. 21 can be implemented in various configurations. For example, the MTM cell segments in FIGS. 16A, 16B and 16C may be arranged in non-planar, 3D configurations for implementing the design in FIG. 20. For another example, U.S. patent application Ser. No. 12/465,571 filed on May 13, 2009 and entitled "Non-Planar Metamaterial Antenna Structures" discloses examples of 3D antennas for implementing the design in FIG. 20. The entire disclosure of the application Ser. No. 12/465,571 is incorporated by reference as part of the disclosure of this document.

In one aspect, the application Ser. No. 12/465,571 discloses an antenna device to include a device housing comprising walls forming an enclosure and a first antenna part located inside the device housing and positioned closer to a first wall than other walls, and a second antenna part. The first antenna part includes one or more first antenna components arranged in a first plane close to the first wall. The second antenna part includes one or more second antenna components arranged in a second plane different from the first plane. This device includes a joint antenna part connecting the first and second antenna parts so that the one or more first antenna components of the first antenna section and the one or more second antenna components of the second antenna part are electromagnetically coupled to form a composite right and left handed (CRLH) metamaterial (MTM) antenna supporting at least one resonance frequency in an antenna signal and having a dimension less than one half of one wavelength of the resonance frequency. In another aspect, the application Ser. No. 12/465,571 discloses an antenna device structured to engage an packaging structure. This antenna device includes a first antenna section configured to be in proximity to a first planar section of the packaging structure and the first antenna section includes a first planar substrate, and at least one first conductive part associated with the first planar substrate. A second antenna section is provided in this device and is configured to be in proximity to a second planar section of the packaging structure. The second antenna section includes a second planar substrate, and at least one second conductive part associated with the second planar substrate. This device also includes a joint antenna section connecting the first and second antenna sections. The at least one first conductive part, the at least one second conductive part and the joint antenna section collectively form a composite right and left handed (CRLH) metamaterial structure to support at least one frequency resonance in an antenna signal. In yet another aspect, the application Ser. No. 12/465,571 discloses an antenna device structured to engage to an packaging structure and including a substrate having a flexible dielectric material and two or more conductive parts associated with the substrate to form a composite right and left handed (CRLH) metamaterial structure configured to support at least one frequency resonance in an antenna signal. The CRLH metamaterial structure is sectioned into a first antenna section configured to be in proximity to a first planar section of the packaging structure, a second antenna section configured to be in proximity to a second planar section of the packaging structure, and a third antenna section that is formed between the first and second antenna sections and bent near a corner formed by the first and second planar sections of the packaging structure.

A tunable MTM antenna structure described in this document can be connected with a control/feedback structure that can tune the antenna to different frequencies if the antenna is exposed to different user environments. For example, the antennas are usually tuned to work in a free space, but when the antenna is held in a hand, the resonance of the antenna shifts. The control/feedback circuit can detect the shift and send a control signal to the tuning circuit for tuning the antenna back to in-band. Furthermore, the above structures can be used to design other RF components such as but not limited to filters, power combiner and splitters, diplexers, and the like. Also, the above structures can be used to design RF front-end subsystems.

While this document contains many specifics, these should not be construed as limitations on the scope of any invention or of what may be claimed, but rather as descriptions of features specific to particular embodiments. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above are acting in certain combinations and even initially claimed as such, one or more features from a claimed combination can in some cases be exercised from the combination, and the claimed combination may be directed to a subcombination or variation of a subcombination.

Thus, particular implementations have been described. Variations, enhancements of the described implementations and other implementations can be made based on what is described and illustrated.

What is claimed is:

1. A metamaterial (MTM) antenna device, comprising:

a ground electrode;

an MTM cell comprising an electrode cell patch;

a launch stub, that is electrically conductive, located nearby and electromagnetically coupled to the MTM cell to direct an antenna signal to or from the MTM cell;

a feed line that is electrically conductive and connects to the launch stub to deliver power of the antenna signal to or from the launch stub;

a via line that is electrically conductive and electrically coupled to the MTM cell;

a tuning circuit coupling the via line to the ground electrode;

a control circuit controlling the tuning circuit which changes an electrical length of the antenna between the via line and the ground electrode upon receiving a control signal from the control circuit to change an antenna frequency which varies with the electrical length of the antenna between the via line and the ground electrode; and a substrate having a first surface and a second, opposing surface, wherein the ground electrode, the MTM cell, the launch pad, the feed line, and the via line are formed on the first surface of the substrate.

2. The device as in claim 1, wherein the tuning circuit comprises:

a capacitor coupling an end portion of the via line to the ground electrode; and a PIN diode coupling a mid portion of the via line to the ground electrode, the mid portion being located between the end portion of the via line and a second end portion of the vial line coupled to the MTM cell, wherein the PIN diode is forward biased in response to a first control signal from the control circuit to connect the mid portion of the via line to the ground electrode, giving rise to a first antenna frequency, and the PIN diode is reverse biased in response to a second control signal from the control circuit to have the capacitor provide a short circuit so that the end portion of the via line is electrically connected to the ground electrode, giving rise to a second antenna frequency lower than the first antenna frequency.

3. The device as in claim 2, wherein the tuning circuit comprises a control electrode connected to the control circuit to receive the control signal and an inductor coupled between the control signal electrode and the via line to apply the control signal to the PIN diode while isolating the control signal electrode from the antenna signal.

4. The device as in claim 1, further comprising:

a first via line segment that is electrically conductive and is coupled to the tuning circuit; and a second via line segment that is electrically conductive and coupled to the tuning circuit, the second via line segment being shorter in length than the first via line segment, wherein the tuning circuit comprises:

a switch coupled to an end portion of the via line, first end portion of the first via line segment, and a first end portion of the second via line segment;

a first capacitor coupling a second end portion of the first via line segment to the ground electrode; and a second capacitor coupling a second end portion of the second via line segment to the ground electrode, wherein the control circuit sends a first control signal to control the switch to connect the via line to the first via line segment and the first capacitor provides a short circuit to form a first signal path by the first via line segment and via line that are electrically connected to the ground electrode to conduct the antenna signal at a first antenna frequency, and wherein the control circuit sends a second control signal to control the switch to connect the via line to the second via line segment and the second capacitor provides a short circuit to form a second signal path by the second via line segment and via line that are electrically connected to the ground electrode to conduct the antenna signal at a second antenna frequency higher than the first antenna frequency.

5. The device as in claim 1 comprising:

a second ground electrode formed on the second surface underneath the ground electrode on the first surface; and one or more conductive vias formed in the substrate to connect the ground electrode on the first surface and the second ground electrode on the second surface.

6. The device as in claim 1, comprising:

a first capacitor coupling a first end portion of the via line to the ground electrode;

a second capacitor coupling a second end portion of the via line to the MTM cell; and wherein the tuning circuit comprises a PIN diode having a first terminal coupled to a mid portion of the via line, located between the first and the second end portions, and a second terminal coupled to the MTM cell, wherein the PIN diode is forward biased in response to a first control signal from the control circuit and reverse biased in response to a second control signal from the control circuit to vary the electrical length of the via line in conducting the antenna signal between MTM cell and the ground electrode.

7. The device as in claim 1, wherein the substrate is flexible.

8. A metamaterial (MTM) antenna device, comprising:

a ground electrode;

a plurality of MTM cell segments separated from and adjacent to one another to form an array with a first MTM cell segment on a first end of the array;

a launch stub that is electrically conductive and located nearby and electromagnetically coupled to the first MTM cell segment to direct an antenna signal to or from the first MTM cell segment;

a feed line that is electrically conductive and is coupled to the launch stub to deliver power to or from the launch stub;

a via line that is electrically conductive and is coupled to the first MTM cell segment to the ground electrode;

a tuning circuit coupling the plurality of MTM cell segments;

a control circuit controlling the tuning circuit to change a length of the array by generating a control signal to control connection between the first MTM cell segment and other MTM cell segments in changing an antenna frequency of the antenna signal based on the length of the array; and a substrate having a first surface and a second, opposing surface, wherein the ground electrode, the plurality of MTM cell segments, the launch stub, the feed and the via line are formed on the first surface of the substrate.

9. The device as in claim 8, wherein the tuning circuit comprises a PIN diode coupling the first cell segment and an adjacent cell segment, wherein the PIN diode is forward biased when the control circuit sends a first control signal, whereby the first cell segment and the adjacent cell segment are electrically connected, giving rise to a low antenna frequency, and wherein the PIN diode is reverse biased when the control circuit sends a second control signal, whereby the first MTM cell segment and the adjacent MTM cell segment are electrically disconnected, giving rise to a high antenna frequency.

10. The device as in claim 9, wherein the tuning circuit comprises a plurality of control circuits, each control circuit comprising a control signal electrode connected to the control circuit to receive a respective control signal and an inductor coupled between die control signal electrode and a respective MTM cell segment that is not the first MTM cell segment to apply the respective control signal to a respective PIN diode while isolating the control signal electrode from the antenna signal.

11. The device as in claim 8, wherein the tuning circuit comprises a plurality of PIN diodes, each coupled between two adjacent MTM cell segments to connect the MTM cell segments in series and being controlled to provide an open circuit or short circuit between the two adjacent MTM cell segments in controlling the length of the array.

12. The device as in claim 8, wherein the MTM cell segments are arranged relative to one another in a non-planar configuration.

13. A metamaterial (MTM) antenna device, comprising:

a dielectric substrate;

a ground electrode formed on the substrate;

a MTM cell formed on the substrate and comprising a conductive cell patch;

a conductive via line formed on the substrate at a location adjacent to and separated from the conductive cell patch, the via line comprising a portion that is electromagnetically coupled to at least a portion of the conductive cell patch and a second portion that is electrically connected to the ground electrode; and a tunable circuit element coupled to the via line and operable to adjust an effective electrical length of the via line to tune a frequency of the MTM cell.

14. The device as in claim 13, wherein the tunable circuit element comprises one or more active components.

15. The device as in claim 14, wherein the tunable circuit element comprises one or more PIN diodes.

16. The device as in claim 14, wherein the tunable circuit element comprises one or more single pole double throw (SPDT) switches.

17. The device as in claim 14, wherein the tunable circuit element comprises one or more single pole N throw (SPNT) switches.

18. A method for providing a multi-frequency operation from a single antenna, comprising:

structuring a Composite Right-Left Handed (CRLH) Metamaterial (MTM) antenna to exhibit antenna resonances at two or more antenna frequencies;

electrically coupling the CRLH MTM antenna to a ground electrode; and adjusting the electrical coupling between the CRLH MTM antenna and the ground electrode to change an electrical length of the electrical coupling to change an operating frequency of the CRLH MTM antenna, wherein the CRLH MTM antenna includes multiple metallization layers patterned to form components of the CRLH MTM antenna.

19. The method as in claim 18, comprising:

connecting a conductive line between the CRLH MTM antenna and the ground electrode to have a first terminal end of the conductive line connected to the CRLH MTM antenna, a second terminal end of the conductive line connected to the ground electrode via a first electrical connector, and a middle portion of the conductive line located between the first and second terminal ends to connect to the ground electrode via a second electrical connector;

operating the first electrical connector to provide an electrical short circuit at a first antenna frequency while operating the second electrical connector to provide an electrical open circuit at the first antenna frequency; and operating the second electrical connector to provide an electrical short circuit at a second antenna frequency higher than the first antenna frequency while operating the first electrical connector to provide an electrical open circuit at the second antenna frequency.

20. The method as in claim 19, wherein the first electrical connector is a capacitor and the second electrical connector is a PIN diode.

21. The method as in claim 18, comprising:

connecting two or more MTM cell segments in series as part of the CRLH MTM antenna; and adjusting a number of two or more MTM segments as part of the CRLH MTM antenna to change the electrical length of the electrical coupling to change the operating frequency of the CRLH MTM antenna.

22. The method as in claim 18, wherein the adjusting of the electric coupling comprises:

coupling two or more conductive paths to the CRLH MTM antenna or the ground electrode to provide alternative paths between the CRLH MTM antenna and the ground electrode, different conductive paths having different electrical lengths; and selectively connecting one of the two or more conductive paths between the CRLH MTM antenna and the ground electrode to operate the CRLH MTM antenna at an antenna frequency defined by the selected conductive path while leaving one or more other conductive paths unconnected between the CRLH MTM antenna and the ground electrode.

23. The method as in claim 18, wherein the CRLH MTM antenna includes CRLH MTM segments arranged relative to one another in a non-planar configuration.

24. A metamaterial (MTM) antenna device, comprising:

a multilayer MTM antenna comprising antenna components formed in multiple metallization layers;

a tuning circuit comprising two or more conductive paths positioned relative to the multilayer MTM antenna, wherein the two or more conductive paths have different electrical lengths; and a control circuit that is coupled to the tuning circuit and controls the tuning circuit by selecting one of the two or more conductive paths to connect to the multilayer MTM antenna to operate the multilayer antenna at an antenna frequency defined by the selected electrical length of the selected one conductive path while leaving one or more other conductive paths unconnected to the multilayer MTM antenna.

25. The device as in claim 24, wherein the multilayer MTM antenna comprises different antenna segments that are arranged in a non-planar configuration.

26. A metamaterial (MTM) antenna device comprising:

a substrate structure including one or more metallization layers;

a ground electrode formed in the one or more metallization layers;

a capacitor coupled to the ground electrode, exhibiting low impedances to radio frequency (RF) signals and providing an open circuit to DC signals; and a plurality of conductive parts formed in at least one of the one or more metallization layers, the conductive parts comprising an MTM cell, a feed line including a distal end nearby and capacitively coupled to the MTM cell to direct an antenna signal to or from the MTM cell, and a via line coupled to the capacitor and the MTM cell, wherein the capacitor, the plurality of conductive parts, and at least part of the substrate structure are configured to form a composite left and right handed (CRLH)

metamaterial structure that exhibits a plurality of frequency resonances associated with the RF signals.

27. The device as claim 26, wherein the MTM cell includes a conductive patch in a metallization layer in which at least part of the ground electrode is formed.

28. The device as in claim 26, comprising a PIN diode coupled between the ground electrode and a connecting point on the via line.

29. The device as in claim 28, comprising a control circuit coupled to the PIN diode to supply a control signal that controls a bias to the PIN diode to turn on or off the PIN diode in controlling an electrical path length between the MTM cell and the ground electrode.

* * * * *

UNITED STATES PATENT AND TRADEMARK OFFICE

CERTIFICATE OF CORRECTION

PATENT NO. : 8,451,183 B2
APPLICATION NO. : 12/546571
DATED : May 28, 2013
INVENTOR(S) : Penev et al.

It is certified that error appears in the above-identified patent and that said Letters Patent is hereby corrected as shown below:

On the title page, in column 2, item (56) under "Other Publications", line 5, delete "Applications." and insert --Applications,--, therefor On the title page, in column 2, item (56) under "Other Publications", line 6, delete "Metamaterials,"" and insert --Metamaterials",--, therefor On the title page, in column 2, item (56) under "Other Publications", line 10, delete "A." and insert --A.,--, therefor On the title page, in column 2, item (56) under "Other Publications", line 14, delete "S." and insert --S.,--, therefor On the title page, in column 2, item (56) under "Other Publications", line 20, delete "INternational" and insert --International--, therefor In the Claims In column 19, line 11, in Claim 1, delete "second," and insert --second--, therefor In column 19, line 23, in Claim 2, delete "vial" and insert --via--, therefor In column 19, line 37, in Claim 3, after "control", insert --signal--, therefor In column 19, line 49, in Claim 4, before "first", insert --a--, therefor In column 20, line 4, in Claim 5, delete "claim 1" and insert --claim 1,--, therefor In column 20, line 51, in Claim 8, after "feed", insert --line,--, therefor Signed and Sealed this
Twenty-third Day of December, 2014

Michelle K. Lee

Michelle K. Lee
*Deputy Director of the United States Patent and Trademark Office*

In column 21, line 2, in Claim 10, delete “die” and insert --the--, therefor

In column 22, line 12, in Claim 21, after “MTM”, insert --cell--, therefor

In column 23, line 3, in Claim 27, after “as”, insert --in--, therefor